US006886371B2

(12) United States Patent
Arai et al.

(10) Patent No.: US 6,886,371 B2
(45) Date of Patent: May 3, 2005

(54) WASHER HAVING A PARTIAL WASHING APPARATUS, AND WASHING APPARATUS

(75) Inventors: Nobushige Arai, Nara (JP); Shinya Takagi, Yamatotakada (JP); Hirofumi Yoshikawa, Osaka (JP); Rie Hiramoto, Yamatokouriyama (JP); Ichirou Ohshima, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 273 days.

(21) Appl. No.: 10/087,731

(22) Filed: Mar. 5, 2002

(65) Prior Publication Data

US 2002/0134117 A1 Sep. 26, 2002

Related U.S. Application Data

(62) Division of application No. 09/559,969, filed on Apr. 28, 2000, now abandoned.

(30) Foreign Application Priority Data

| | | |
|---|---|---|
| Apr. 28, 1999 | (JP) | 11-121087 |
| Apr. 28, 1999 | (JP) | 11-1210414 |
| May 12, 1999 | (JP) | 11-130743 |
| Oct. 20, 1999 | (JP) | 11-297959 |
| Nov. 4, 1999 | (JP) | 11-313490 |

(51) Int. Cl.[7] ..... D06F 19/00

(52) U.S. Cl. ..... 68/3 R; 68/3 SS; 68/13 R; 68/205 R

(58) Field of Search ..... 312/228, 228.1; 68/3 SS, 3 R, 13 R, 5 A, 13 A, 200, 205 R, 213, 235; 134/64 R, 122 R, 184

(56) References Cited

U.S. PATENT DOCUMENTS

| | | | | |
|---|---|---|---|---|
| 927,549 A | * | 7/1909 | Kezer | 68/20 |
| 1,564,760 A | * | 12/1925 | Culver | 68/184 |
| 1,769,764 A | * | 7/1930 | Barker | 68/23.5 |
| 1,777,453 A | * | 10/1930 | Seery et al. | 422/282 |
| 2,584,943 A | * | 2/1952 | Thomas | 239/458 |
| 3,007,478 A | * | 11/1961 | Leonhardt et al. | 134/57 R |
| 3,173,730 A | * | 3/1965 | Collins | 312/223.5 |
| 3,334,567 A | * | 8/1967 | Benson | 134/198 |
| 3,342,336 A | * | 9/1967 | Rose | 210/134 |
| 3,577,214 A | * | 5/1971 | Levan et al. | 8/137 |
| 3,611,456 A | * | 10/1971 | Hildebrandt | 8/149.1 |
| 3,679,483 A | * | 7/1972 | Zweig | 134/46 |
| 3,688,527 A | * | 9/1972 | Blustain | 68/3 SS |

(Continued)

FOREIGN PATENT DOCUMENTS

| | | | |
|---|---|---|---|
| JP | 1-213458 | * | 8/1989 |
| JP | 1-256918 | * | 10/1989 |
| JP | 2-55093 | * | 2/1990 |
| JP | 2-71792 | * | 3/1990 |
| JP | 2-191761 | * | 7/1990 |
| JP | H 324081 | | 3/1991 |
| JP | 3-60697 | * | 3/1991 |
| JP | H4 224793 | | 8/1992 |
| JP | 10-5711 | * | 1/1998 |
| JP | 10-128175 | * | 5/1998 |

*Primary Examiner*—Frankie L. Stinson
(74) *Attorney, Agent, or Firm*—Birch, Stewart, Kolasch & Birch, LLP

(57) ABSTRACT

A washing machine has a partial washing apparatus, which has a supersonic resonator, which is driven by an oscillator to generate supersonic vibration and a supersonic vibration horn. A washing liquid is fed to the partial washing apparatus so as to be agitated by supersonic waves, which are then fed to an article to be washed to achieve partial washing of the article. The partial washing apparatus is detachably fitted to the washing machine proper at approximately the center of a lid of the washing machine proper. The partial washing apparatus may be used as a handy-type partial washing apparatus when held at a grip portion of the partial washing apparatus.

27 Claims, 26 Drawing Sheets

U.S. PATENT DOCUMENTS 3,729,013 A 4/1973 Andersson
3,804,297 A 4/1974 Jurjans
4,103,520 A 8/1978 Jarvis et al.
4,431,684 A * 2/1984 Strohmaier ..... 118/300
4,591,485 A * 5/1986 Olsen et al. ..... 422/20
4,686,123 A * 8/1987 Levan ..... 427/424
4,687,121 A 8/1987 Copeland et al.
4,779,430 A 10/1988 Thuruta et al.
4,906,318 A * 3/1990 Miyazaki ..... 156/352
4,926,514 A * 5/1990 Leuenberger ..... 8/150
4,932,227 A 6/1990 Hogrefe
4,981,024 A 1/1991 Beldham
5,203,044 A * 4/1993 Jung, Jr. ..... 8/149.1
5,208,930 A 5/1993 Chabard
5,232,299 A * 8/1993 Hiss ..... 401/143
5,241,843 A 9/1993 Hein
5,270,248 A * 12/1993 Rosenblum et al. ..... 438/61
5,381,574 A * 1/1995 VonPless ..... 8/149.2
5,987,659 A * 11/1999 Cannizzaro ..... 4/420.2
6,357,057 B1 * 3/2002 Krist ..... 4/520.4
6,376,444 B1 * 4/2002 Hortel et al. ..... 510/277
6,391,061 B1 * 5/2002 Hortel et al. ..... 8/137.5
6,461,446 B1 * 10/2002 Satoh et al. ..... 134/42
6,482,242 B1 * 11/2002 Yarmosky ..... 8/149.1
6,483,087 B1 * 11/2002 Gardner et al. ..... 219/545

* cited by examiner

WASHER HAVING A PARTIAL WASHING APPARATUS, AND WASHING APPARATUS

This application is a divisional of application Ser. No. 09/559,969, filed on Apr. 28, 2000, now abandoned, the entire contents of which are hereby incorporated by reference and for which priority is claimed under 35 U.S.C. § 120; and this application claims priority of application Ser. No. H11-297959, H11-313490, H11-130743, H11-121087, H11-121014 filed in Japan on Oct. 20, 1999, Nov. 4, 1999, May 12, 1999, Apr. 28, 1999, and Apr. 28, 1999, respectively, under 35 U.S.C. § 119.

BACKGROUND OF THE INVENTION

1. Field of the Invention

The present invention relates to a washer (washing machine) having a partial washing apparatus that removes dirt from a partially soiled article to be washed by means of a washing liquid agitated by supersonic vibration, and thus the present invention relates generally to a washing apparatus.

2. Description of the Prior Art

Shirts soiled with obstinate dirt at their collars and cuffs, or socks so soiled, need to be subjected to preparatory washing before being washed in a washing machine. Such preparatory washing, however, is achieved by rubbing an article to be washed by hand, or washing it by hand with a brush, and thus not only takes time and labor but also damages the fiber of which the article is made.

To overcome this problem, Japanese Laid-Open Patent Application H4-2247093 proposes a partial washing apparatus that removes dirt from a partially soiled article to be washed by means of a washing liquid agitated by supersonic vibration. FIG. 29 is a perspective view of a washing machine provided with this partial washing apparatus. The partial washing apparatus 204 is composed essentially of a jet nozzle 201 that is fixed to a washing machine proper 202 so as to be placed above a washing sink 203, a washing liquid feeder 205 for feeding a washing liquid to the jet nozzle 201, and a supersonic vibration generator 206 for generating supersonic vibration inside the jet nozzle 201.

When the washing liquid feeder 205 and the supersonic vibration generator 206 are activated, a jet of the washing liquid agitated by the supersonic vibration applied thereto from the jet nozzle 201 is emitted into the washing sink 203. By exposing a soiled portion of an article to be washed to this jet of the washing liquid, it is possible to separate and remove the soil as a result of the synergistic effect of the vibration acceleration and the jet pressure of the washing liquid.

However, in this washing machine, the jet nozzle 201, which is fixed so as to be placed above the washing sink 203, protrudes toward the center of an opening 207 to the washing sink 203. Thus, the jet nozzle 201 becomes an obstacle when articles to be washed are put into the washing sink 203 or when washed articles are taken out of it. In particular when washed articles are taken out of the washing sink 203, they may be caught on the jet nozzle 201 in such a way as to damage it.

The jet nozzle 201 is designed to retract inside the washing machine proper 202 when a lid 208 is closed. Accordingly, the jet nozzle 201 is fixed at about the same level as the opening 207 that is located at a height of about 750 to 800 mm above the floor. Thus, the jet nozzle 201 is fixed at a level somewhat lower than the hands of an average user. This requires the user to keep his or her body bent forward while performing partial washing. In the first place, users of different stature have their hands at different levels when doing such washing. Therefore, placing the jet nozzle 201 at a fixed height as in this washing machine forces users to do washing in uncomfortable positions, and thus increases their fatigue unnecessarily.

Moreover, this type of partial washing apparatus uses supersonic vibration in a comparatively high frequency range of about 500 kilohertz to several megahertz. In addition, in the partial washing apparatus described above, the supersonic vibration is squeezed by the jet nozzle 201 to obtain a higher energy density. As a result, the washing liquid emitted from the jet nozzle 201 has a flow rate of about several meters per second, and thus, on hitting an article to be washed, it often splashes around, making the surroundings of the washing machine wet.

Moreover, the supersonic vibration of the washing liquid emitted from the jet nozzle 201 has the maximum intensity at the tip of the jet nozzle 201, and its intensity abruptly decays at distances of several tens of millimeters or longer from the tip of the jet nozzle 201, though how it decays depends somewhat on the frequency of the supersonic vibration. Accordingly, a satisfactory washing effect can be achieved only when an article to be washed is held within a limited range of distances from the jet nozzle 201.

For example, if the supersonic vibration has a frequency of 1 MHz, an article to be washed needs to be washed at a distance of about 20 mm from the tip of the jet nozzle 201. However, in the washing machine described above, it is difficult to hold an article to be washed at a fixed distance from the jet nozzle 201, and therefore, depending on how the article is actually washed, a quite unsatisfactory washing effect may result.

Moreover, supersonic vibration in a high frequency range reaches so deep into the human body that the portion of the body affected by it feels sore, and also is believed to have adverse effects on cartilage. In view of this, with the partial washing apparatus 204 described above, which have no protective means for preventing the user's hands and fingers from touching the washing liquid agitated by supersonic vibration in a relatively high frequency range, the user may be exposed to the risk of suffering injuries to his or her hands.

Moreover, in cases where tap water is used as the washing liquid for partial washing, the detergent applied beforehand to an article to be washed does not dissolve into it well. Thus, to obtain a satisfactory washing effect, more detergent needs to be used, which adds to the pollution of the environment through sewage.

In the first place, it is troublesome to apply detergent for partial washing beforehand to every soiled portion of articles to be washed. Then, a jet of the washing liquid is emitted to each soiled portion to which the detergent has thus been applied beforehand. At this time, the washing liquid is emitted at a flow rate as high as several liters per minute, and thus washes the detergent away, leading to an unsatisfactory washing effect. Moreover, obstinate dirt may require repeated application of the detergent, which adds to the trouble of such partial washing.

Moreover, not only to conform to the recent trend toward larger washing capacities, but also to offer more sophisticated functions, modern washing machines have come to have more and more complicated constructions. This makes it difficult to house inside the washing machine proper 202 a washing liquid feeder 205 for feeding the washing liquid into the washing sink 203. The washing liquid feeder 205 may be arranged so as to protrude outside the washing machine proper, but this makes the washing machine difficult to install and handle, because nowadays less and less space tends to be left for a washing machine as a clothes dryer and other appliances become more and more popular.

On the other hand, in recent years, various types of detergent have been developed and are commercially available for different degrees of soil, different kinds of fiber, and different conditions of other factors. For example, there are available detergent for oil stains, detergent for light dirt, detergent for clothes labeled as fit for dry cleaning only, and detergent for clothes labeled as requiring no ironing. By applying appropriate types of detergent to articles to be washed before subjecting them to partial washing, it is possible to obtain a satisfactory washing effect with various types of articles. This applies not only to partial washing, but also to ordinary washing, where using different types of detergent for different conditions also makes it possible to do washing in manners most suitable for given types of articles.

Japanese Laid-Open Utility Model Application No. H3-24081 discloses a washing machine that can feed different types of washing liquid automatically. As shown in FIG. 30, this washing machine is provided with a plurality of liquid-feed tanks 103 each having a check valve 101 and a solenoid valve 102. A controller 104 opens the solenoid valves 102 to appropriate degrees, and drives a compressed air feeder 105 to feed compressed air to air inlets 107 and 108 of a cylinder pump 106 so as to move a piston 109 up and down. This permits the washing liquids stored in the individual liquid-feed tanks 103 to be sucked up sequentially and fed to the articles to be washed put in the washing sink 110.

However, this washing machine, though provided with a plurality of liquid-feed tanks 103, simply drives the cylinder pump 106 in accordance with a program stored beforehand so that the detergents stored in the individual liquid-feed tanks 103 are sucked up sequentially and fed to the washing sink 110. That is, this washing machine does not permit the user to select detergents most appropriate for given types of articles to be washed.

Moreover, this washing machine requires that its liquid-feed tanks 103 be each provided with a check valve 101 and a solenoid valve 102, and in addition requires the provision of a compressed air feeder 105 and a cylinder pump 106. Thus, this washing machine has too complicated a construction to be practical.

SUMMARY OF THE INVENTION

An object of the present invention is to provide a washing machine having an easy-to-use partial washing apparatus that permits partial washing without becoming an obstacle.

Another object of the present invention is to provide a washing machine having a partial washing apparatus that allows partial washing with a satisfactory washing effect without splashing around a washing liquid.

Another object of the present invention is to provide a washing machine having a partial washing apparatus that permits selective use of detergents most appropriate for given types of articles to be washed and that allows partial washing while being space-saving.

Another object of the present invention is to provide a washing apparatus that achieves a satisfactory washing effect.

Another object of the present invention is to provide a washing apparatus that permits selective use of detergents most appropriate for given types of articles to be washed while being space-saving.

To achieve the above objects, according to one aspect of the present invention, in a washing machine incorporating a partial washing apparatus that removes dirt from an article to be washed by feeding a washing liquid agitated by supersonic vibration to the article to be washed, the partial washing apparatus is fitted to the washing machine proper with a holding member that holds the partial washing apparatus movably relative to the washing machine proper.

According to another aspect of the present invention, in a washing machine incorporating a partial washing apparatus that removes dirt from an article to be washed by feeding a washing liquid agitated by supersonic vibration to the article to be washed, the partial washing apparatus is provided with: a supersonic resonator for generating supersonic vibration; and a supersonic vibration horn, arranged with the tip thereof placed near the article to be washed, for amplifying the supersonic vibration.

According to another aspect of the present invention, in a washing machine incorporating a partial washing apparatus that removes dirt from an article to be washed by feeding a washing liquid agitated by supersonic vibration to the article to be washed, the partial washing apparatus is provided with: a supersonic resonator for generating supersonic vibration; a supersonic vibration horn, arranged with the tip thereof placed near the article to be washed, for amplifying the supersonic vibration; and a liquid-feed tank for storing the washing liquid, which is fed therefrom to the tip of the supersonic vibration horn.

According to another aspect of the present invention, in a washing machine incorporating a partial washing apparatus that removes dirt from an article to be washed by feeding a washing liquid agitated by supersonic vibration to the article to be washed, the washing liquid is functional water obtained by altering the properties of tap water in such a way that it offers higher detergent solubility or higher supersonic transmission efficiency.

According to another aspect of the present invention, in a washing apparatus that washes an article Lo be washed by feeding a washing liquid stored in a liquid-feed tank to the article to be washed, the liquid-feed tank permits a plurality of washing liquids to he stored separately so that one of the washing liquids can be selectively fed to the article to be washed.

According to another aspect of the present invention, in a washing apparatus that removes dirt from an article to be washed by feeding a washing liquid agitated by supersonic vibration to the article to be washed, the washing liquid is functional water obtained by altering the properties of tap water in such a way that it offers higher detergent solubility or higher supersonic transmission efficiency.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
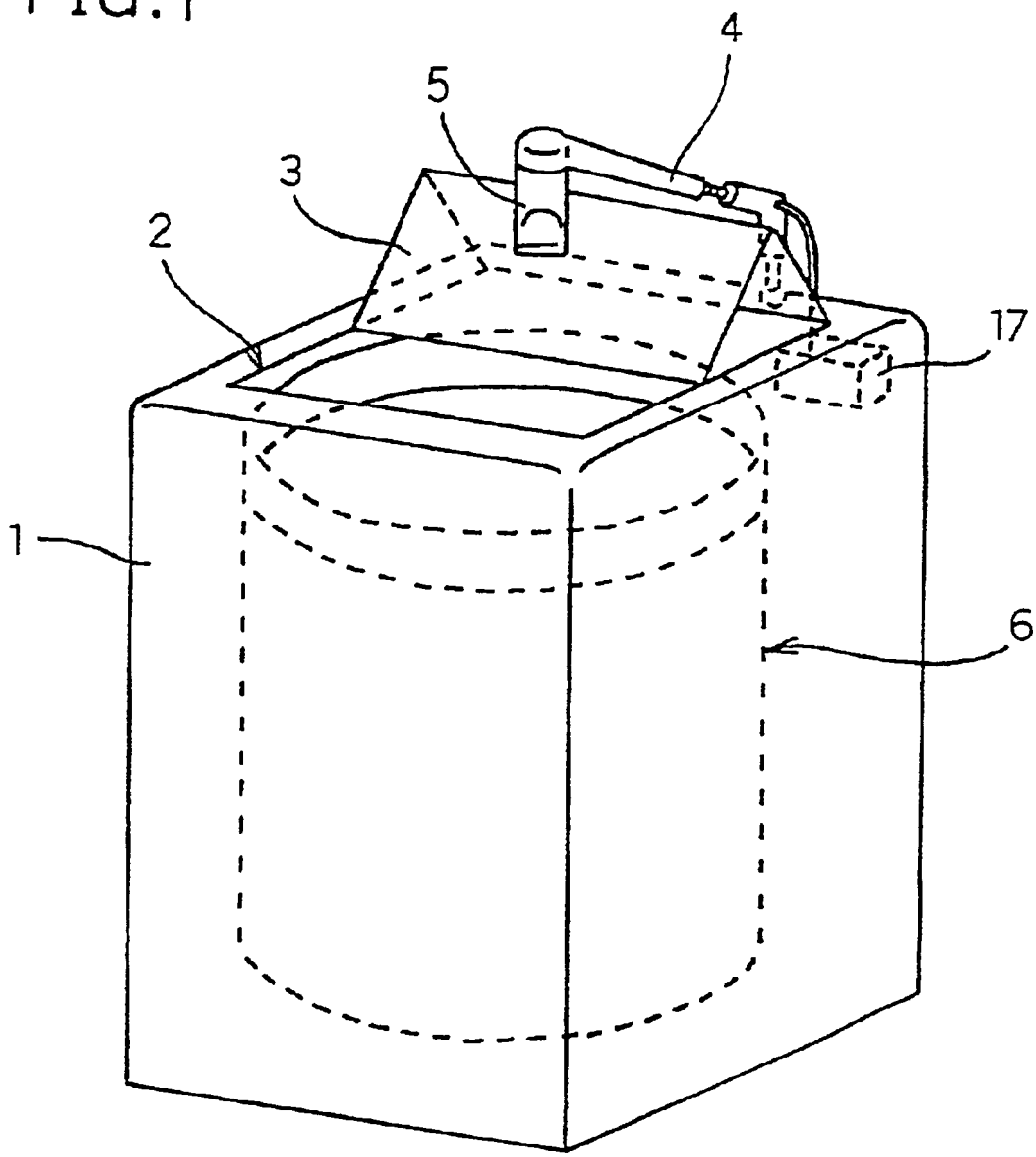
FIG. 1 is a perspective view of the washing machine having a partial washing apparatus of a first embodiment of the invention.

Hereinafter, embodiments of the present invention will be described with reference to the accompanying drawings. FIG. 1 is a perspective view of the washing machine having a partial washing apparatus of a first embodiment of the invention. On the top surface of a washing machine proper 1, an opening 2 is formed, which can be closed by a lid 3 that is folded in two when opened. A substantially L-shaped holding member 4 protrudes from behind the lid 3. At the tip of this holding member 4, a partial washing apparatus 5 is fitted so as to be held above a washing sink 6 provided inside the washing machine proper 1.

Figure 2:
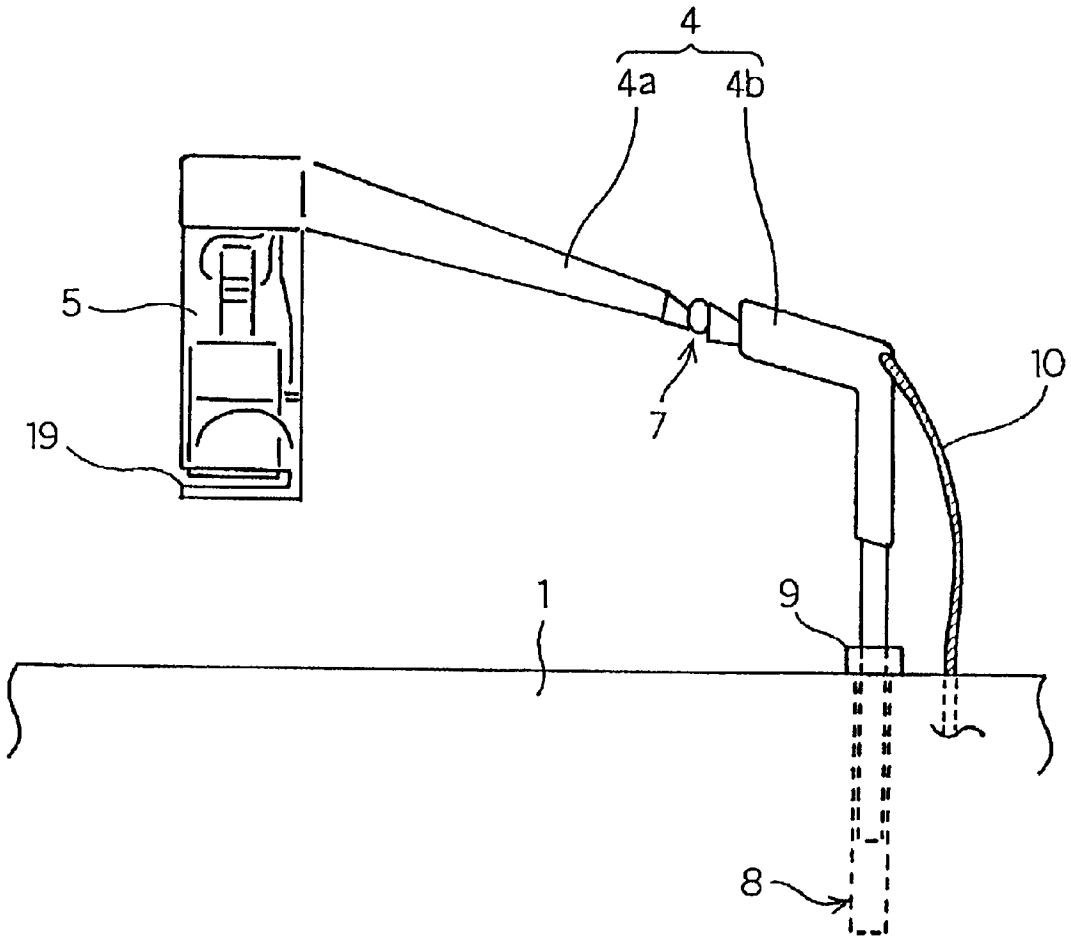
FIG. 2 is a side view of a portion, where the partial washing apparatus is fitted, of the washing machine having a partial washing apparatus of the first embodiment.

FIG. 2 is a side view of the holding member 4, showing it in more detail. The holding member 4 is composed of a substantially I-shaped holding portion 4*a* and a substantially L-shaped supporting portion 4*b*. The holding portion 4*a* and the supporting portion 4*b* are coupled together with a ball-joint member 7. The partial washing apparatus 5 is fitted to one end of the holding portion 4*a*.

In the top surface of the washing machine proper 1, a fitting hole 8 is formed so as to extend vertically. The supporting portion 4*b* is put through a ring-shaped stopper member 9 and is fitted slidably into the fitting hole 8. The stopper member 9 has an inner diameter approximately identical with the outer diameter of the supporting portion 4*b* so as to be kept in close contact with and thereby prevent free movement of the supporting portion 4*b*. Thus, by fitting the stopper member 9 in an appropriate position around the supporting portion 4*b*, the stopper member 9, when the supporting portion 4*b* is fitted into the fitting hole 8, makes contact with the top surface of the washing machine proper 1 and thereby prevents the supporting portion 4*b* from sinking further into the fitting hole 8.

A harness 10, consisting of a water-feed pipe and electric leads as will be described later tied together, extends out of the washing machine proper 1 into the supporting portion 4*b*. These water-feed pipe and electric leads are laid through the supporting portion 4*b*, then through the ball-joint member 7, and then through the holding portion 4*a* so as to be connected eventually to the partial washing apparatus 5.

As described above, the supporting member 4 has its supporting portion 4*b* fitted slidably into the fitting hole 8. Therefore, by changing the position of the stopper member 9 that is fitted around the supporting portion 4*b*, it is possible to change freely the height of the partial washing apparatus 5. Since the stopper member 9 is simply kept in close contact with the supporting portion 4*b*, it can be moved along the supporting portion 4*b* by applying a force greater than a predetermined level.

Moreover, the bottom surface of the stopper member 9 is slidable on the top surface of the washing machine proper 1, and this allows the supporting portion 4*b* to rotate in the fitting hole 8. Thus, the holding portion 4*a* and the partial washing apparatus 5 are rotatable in a horizontal plane about the supporting portion 4*b*.

Moreover, since the holding portion 4*a* and the supporting portion 4*b* are coupled together with a ball-joint member 7, the tip end of the holding portion 4*a* is movable three-dimensionally about the other end thereof which is coupled to the supporting portion 4*b*. Thus, the partial washing apparatus 5 fixed at the tip end of the supporting portion 4*a* is movable accordingly. In the ball-joint member 7, a diameter of about 6 mm can be secured for the above-mentioned water-feed pipe that is laid together with the electric leads, and therefore the movement of the holding portion 4*a* does not hamper the feeding of water.

Figure 3:
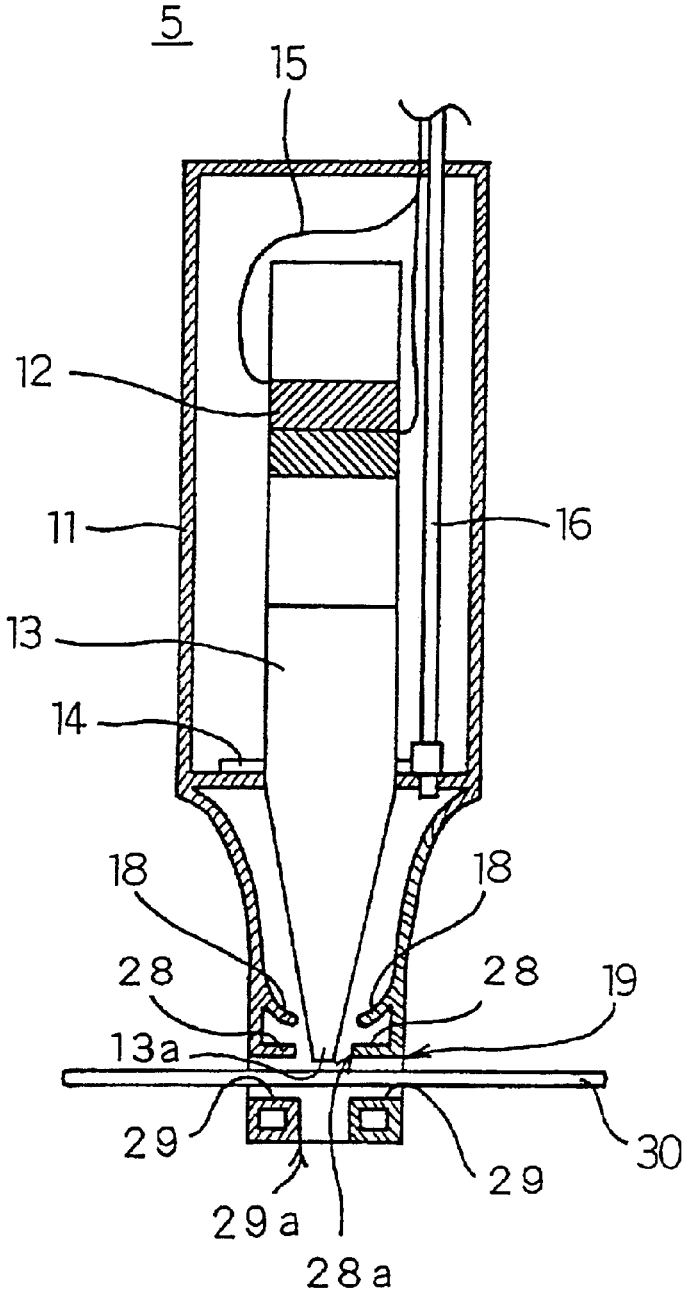
FIG. 3 is a sectional view, as seen from the front, of the partial washing apparatus of the washing machine having a partial washing apparatus of the first embodiment.

FIG. 3 is a sectional view, as seen from the front, of the partial washing apparatus 5. It is enclosed in a case 11 that is made of a transparent material and that has a cylindrical shape narrowed from both sides in its lower portion. Inside the case 11 are housed a supersonic resonator 12 for generating supersonic vibration and a supersonic vibration horn 13 for amplifying the supersonic vibration. The supersonic vibration horn 13 is supported by a supporting flange 14 in such a way that it can vibrate freely.

The electric leads 15 and the water-feed pipe 16 are introduced into the case 11 at the top end thereof. The electric leads 15 connect the supersonic resonator 12 to an oscillator 17 (see FIG. 1) provided in the washing machine proper 1. The water-feed pipe 16 originates from a three-way valve (not shown) connected to the water inlet to the washing machine proper 1 and reaches the supporting flange 14.

On the inner wall of the case 11, near the tip of the supersonic vibration horn 13, a guide portion 18 is formed, by which the water (washing liquid) emitted from the water-feed pipe 16 is guided, in a uniform current, to the tip of the supersonic vibration horn 13.

Below the guide portion 18 is formed a slit 19 in which to insert an article 30 to be washed. As shown in FIG. 2, the slit 19 is open at the front surface of the case 11 and extends therefrom rearwards. The slit 19 is formed by an upper cover 28 and a lower cover 29. These upper and lower covers 28 and 29 ensure smooth sliding of the article 30 when it is inserted in the slit 19.

The upper and lower covers 28 and 29 have openings 28*a* and 29*a* formed at their respective center. The supersonic vibration horn 13 is arranged with its tip 13*a* located in the opening 28*a* of the upper cover 28, at a level identical with or slightly lower than the opening 28*a*. The opening 29*a* of the lower cover 29 permits the washing liquid guided by the guide portion 18 to the tip 13*a* of the supersonic vibration horn 13 to flow downward out.

Now, how this partial washing apparatus 5 constructed as described above operates will be described. First, when the supersonic resonator 12 receives from the oscillator 17 a driving signal, it oscillates at its resonance frequency. This oscillation is amplified by the supersonic vibration horn 13 and appears at the tip 13*a* thereof. Here, the amplitude of the oscillation is amplified several times to several tens of times, depending on the material of the supersonic vibration horn 13.

The washing liquid is fed from the water inlet (not shown) through the water-feed pipe 16 into the case 11, and then flows down inside the case 11. The washing liquid is then guided by the guide portion 18 to the tip 13*a* of the supersonic vibration horn 13 so as to be agitated by supersonic vibration. This causes capillary waves in the washing liquid, and thereby the washing liquid is made into fine particles and accelerated, and then flows downward out through the opening 29*a* of the lower cover 29.

When the user inserts a soiled portion of an article 30 to be washed into the slit 19 and slides it laterally repeatedly, the washing liquid agitated by supersonic vibration is fed to the article 30. Moreover, at this time, the article 30 slightly touches the tip 13*a* of the supersonic vibration horn 13. This causes intense cavitation on the surface and in the fiber of the article 30. In addition, physical vibrating mechanical force is applied directly to the article 30. The synergistic effect of these makes highly effective removal of partially deposited dirt possible.

The user determines whether to continue or end partial washing by checking the progress of washing by sight. On completion of partial washing, the article 30 is, as it is, thrown into the washing sink 6 so as to be subjected to ordinary washing subsequently.

In this embodiment, the partial washing apparatus 5 is so constructed that the washing liquid flows downward out through the opening 29*a* provided at the bottom end of the case 11. Thus, this partial washing apparatus 5 is convenient to use above the washing sink 6 because it allows the washing liquid to flow out directly into the washing sink 6. Moreover, an article 30 to be washed that has already been subjected to partial washing can easily be thrown into the washing sink 6.

Moreover, when the partial washing apparatus 5 is used above the washing sink 6, its height can be adjusted to the level of the user's hands by means of the holding member 4. This permits the user to perform partial washing in a comfortable position.

Moreover, the partial washing apparatus 5 can be rotated in a horizontal plane by means of the holding member 4, and therefore, when it is not used, it can be rotated so as to be retracted rearward. Furthermore, since the partial washing apparatus 5 is movable three-dimensionally by means of the ball-joint member 7, it can easily be retracted a little when the lid 3 is opened or closed and then put back into the original position. Therefore, even through the partial washing apparatus 5 is located above the washing sink 6, it does not become an obstacle when an article 30 to be washed is put into or taken out of the washing sink 6, or when the lid 3 is opened or closed.

The partial washing apparatus 5 may be so constructed as to be removable from the holding member 4. This makes removal of the partial washing apparatus 5 possible and thereby makes partial washing easy particularly when handling a large article 30 to be washed.

In the partial washing apparatus 5 of this embodiment, the washing liquid fed to an article 30 to be washed is made into mist by the supersonic vibration horn 13, and its flow rate is as low as about 0.1 liters per minute. Thus, even if the article 30 is brought close to the supersonic vibration horn 13, the washing liquid does permeate the article 30, but does not splash around.

Moreover, the vibration energy generated by the supersonic resonator 12 is made to converge by the supersonic vibration horn 13, and therefore the energy density at the tip thereof is so high as to readily exceed several tens of watts per square centimeter. Thus, there is the risk of the user's hands, when exposed to this vibration, absorbing it and suffering burns or other injuries. However, the construction in which an article 30 to be washed is inserted into the slit 19 formed in the case 11 helps prevent the user's hands from touching the tip of the supersonic vibration horn 13, and thereby ensures safe partial washing.

Now, the results of cloth washing tests actually conducted with the partial washing apparatus 5 of this embodiment will be presented. These tests were conducted in conformity with the electric washing machine washing test method formulated in JIS (Japanese Industrial Standard) C9606, according to which artificially soiled cloths (soiled with artificial sebum-like substance) are washed as test cloths to determine washing efficacy (%) that is defined as Washing Efficacy (%)=(Reflectance After Washing—Reflectance Before Washing)/(Reflectance of Unsoiled Cloth—Reflectance Before Washing)×100.

In these tests, an oscillator oscillating at 40 kHz and yielding an output of 30 W was used, and a standard amount of a commercially available detergent for partial washing was applied beforehand to each of the test cloths.

Figure 4:
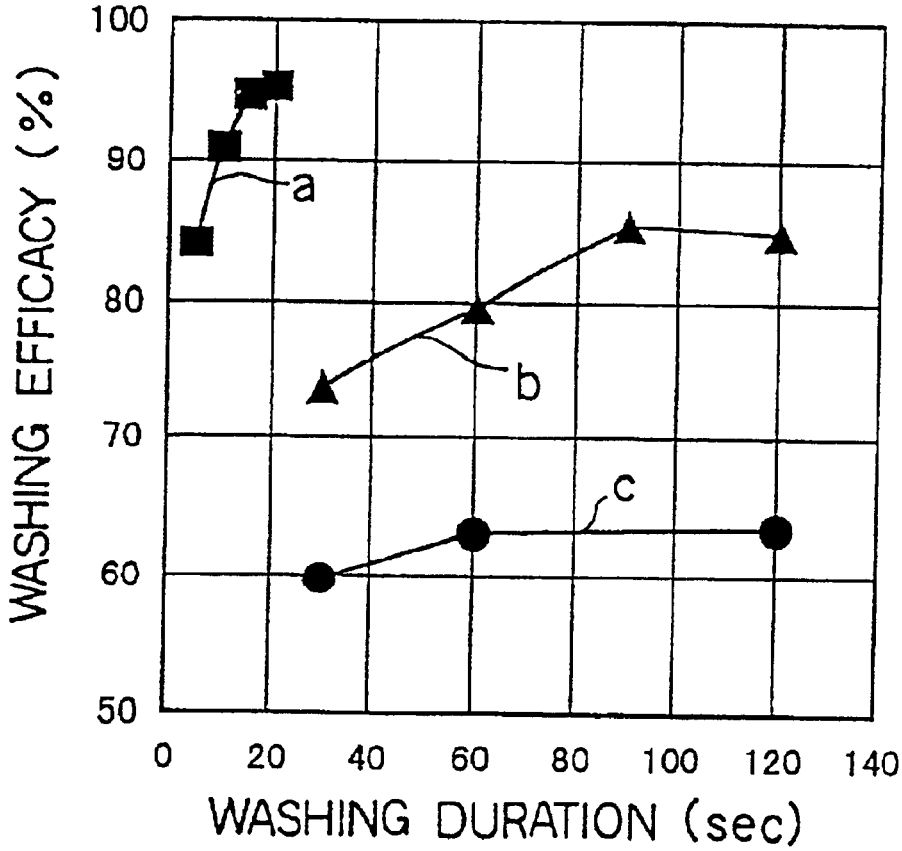
FIG. 4 is a diagram showing:g the results of washing tests conducted on the washing machine having a partial washing apparatus of the first embodiment.

FIG. 4 shows the results of the washing tests, with the washing efficacy (%) plotted for different washing duration and methods. In this figure, the graph (a) represents the results of supersonic washing according to this embodiment, the graph (b) the results of conventional washing using a brush, and the graph (c) the results of conventional washing by hand rubbing. As FIG. 4 shows, supersonic washing using the partial washing apparatus 5 achieves washing efficacy exceeding 90% for washing duration as short as 10 seconds. By contrast, washing by hand rubbing or with a brush is far from achieving any washing efficacy close to 90% even for 12 times as long washing duration of 120 second. This proves the excellent washing effect achieved by the partial washing apparatus 5.

Moreover, damage resulting from friction was observed in the artificially soiled cloth that were washed by hand rubbing or with a brush. By contrast, almost no damage was discernible in the soiled cloth that were washed by supersonic vibration. This proves the superiority of the partial washing apparatus also in terms of prevention of damage to the cloths.

Figure 5:
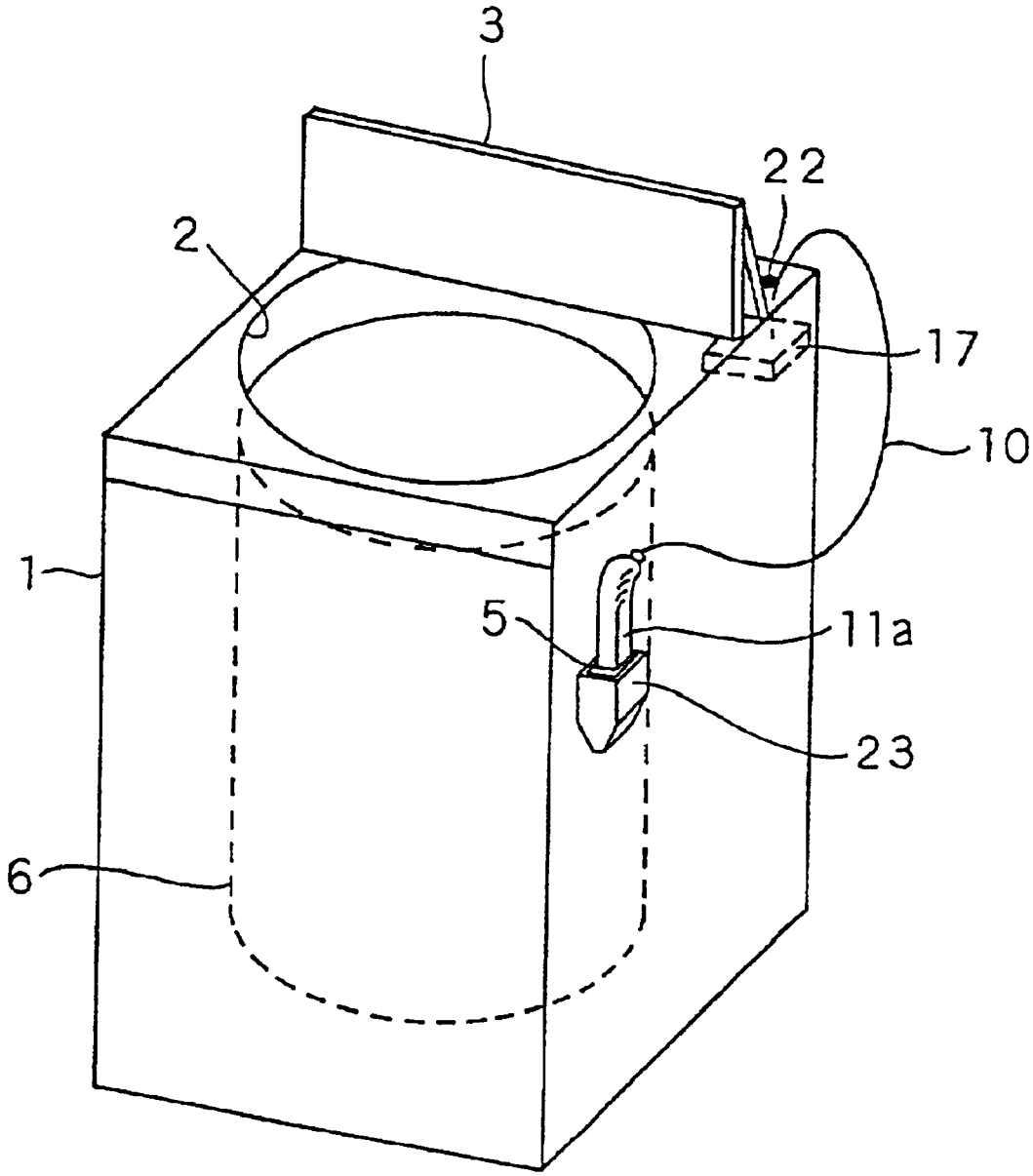
FIG. 5 is a perspective view of the washing machine having a partial washing apparatus of a second embodiment of the invention.

FIG. 5 is a perspective view of the washing machine having a partial washing apparatus of a second embodiment of the invention. For convenience' sake, in the following descriptions, such components as are found also in the first embodiment shown in FIGS. 1 to 3 are identified with the same reference numerals. Accordingly, also in this embodiment, reference numeral 1 represents a washing machine proper, 3 represents a lid, 6 represents a washing sink, 5 represents a partial washing apparatus, 10 represents a harness, consisting of a water-feed pipe and electric leads tied together, and 17 represents an oscillator.

Reference numeral 22 represents a water inlet that is connected to a faucet to feed water from the faucet to the washing sink 6. Reference numeral 23 represents a bracket member for permitting the partial washing apparatus 5 to be housed therein so as to be kept in a fixed position on the washing machine proper 1. The bracket member 23 is fitted to the washing machine proper 1 by magnetic force or other means.

Figure 6:
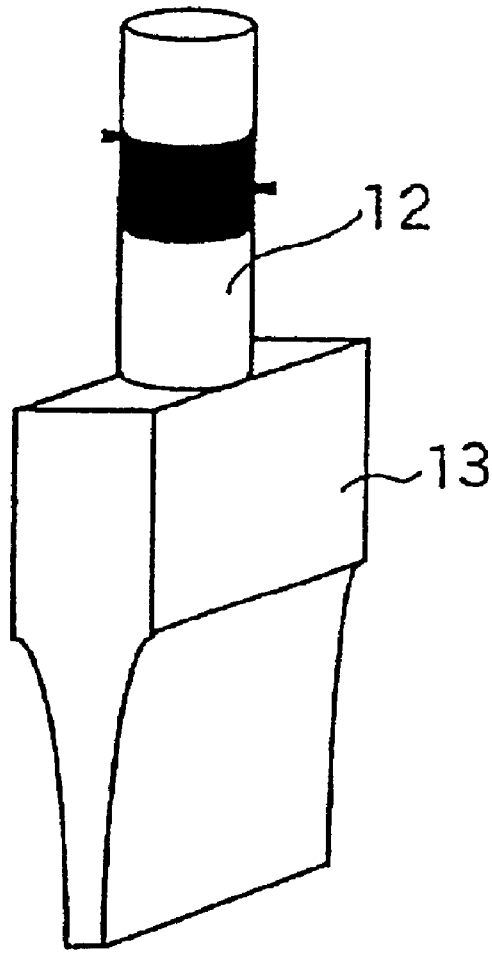
FIG. 6 is a perspective view of the supersonic resonator and the supersonic vibration horn of the washing machine having a partial washing apparatus of the second embodiment.

The partial washing apparatus 5 has a supersonic vibrator and a water feeder housed in a case. FIG. 6 is a perspective view of the supersonic vibrator. Reference numeral 12 represents a supersonic resonator that vibrates at a supersonic frequency in response to a driving signal fed from the oscillator 17 (see FIG. 5), and reference numeral 13 represents a supersonic vibration horn that amplifies the supersonic vibration.

Figure 7:
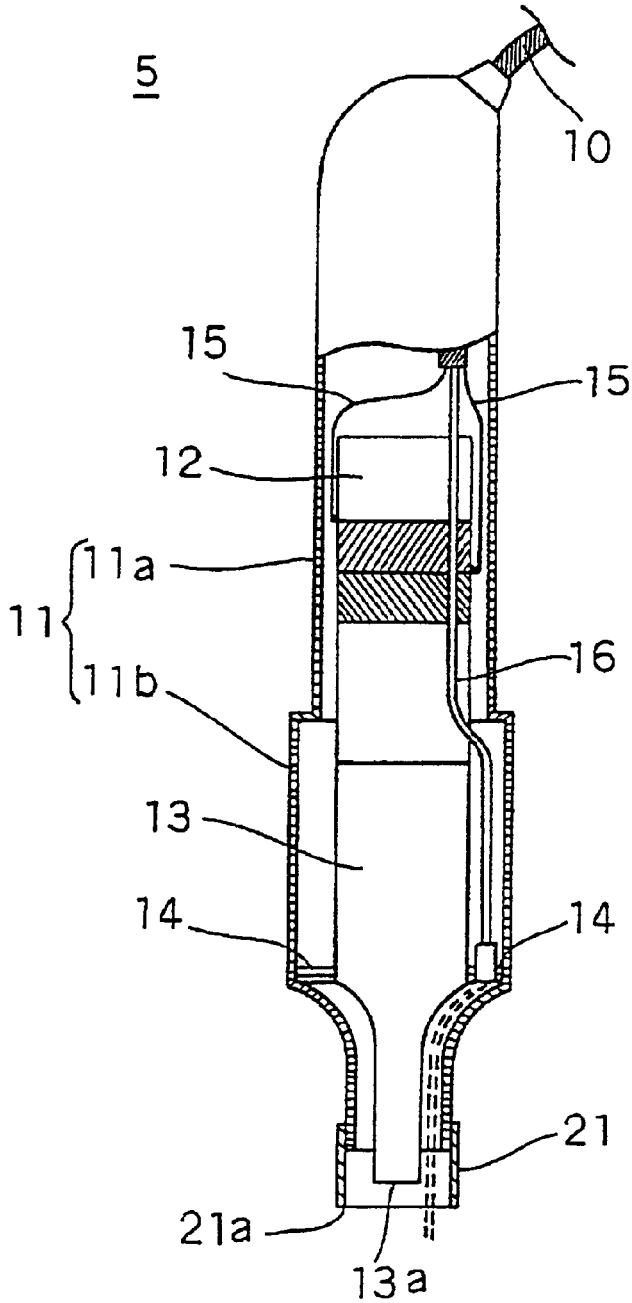
FIG. 7 is a sectional view, as seen from the front, of the partial washing apparatus of the washing machine having a partial washing apparatus of the second embodiment.

FIG. 7 is a sectional view of the partial washing apparatus 5. The case 11 is composed of a grip portion 11*a* constituting an upper portion thereof and a body portion 11*b* constituting a lower portion thereof. Inside the case 11, the supersonic vibrator, composed of the supersonic resonator 12 and the supersonic vibration horn 13, is supported in a fixed position by a supporting flange 14. The supersonic vibration horn 13 is arranged inside the body portion 11*b*, and the tip of the body portion 11*b* is made narrower in the same manner as the tip of the supersonic vibration horn 13.

The harness 10 introduced into the case 11 at the top end of its grip portion 11*a* is composed of electric leads 15 and a water-feed pipe 16. The electric leads 15 connect the supersonic resonator 12 to the oscillator 17 (see FIG. 5). The water-feed pipe 16 is, at one end, connected to the water inlet 22 (see FIG. 5), and, at the other end, reaches the supporting flange 14.

The case 11 has a cylindrical cover 21 fitted around the bottom end thereof from the outside. The cover 21 is vertically slidable within a limited range along the case 11. FIG. 7 shows the cover 21 in its lowest position, in which state the tip 13*a* of the supersonic vibration horn 13 is completely enclosed inside the cover 21. When the cover 21 is in its highest position, the tip 13*a* is exposed.

Now, how this partial washing apparatus 5 is used will be described. As shown in FIG. 5, when the partial washing apparatus 5 is kept in the bracket member 23 for storage, the grip portion 11*a* is left outside the bracket member 23 so that the user can take out the partial washing apparatus 5 by holding the grip portion 11*a*.

In the partial washing apparatus 5, the supersonic resonator 12 receives a driving signal from the oscillator 17 and vibrates at its resonance frequency. This vibration is amplified by the supersonic vibration horn 13 and appears at the tip 13*a* thereof.

On the other hand, the washing liquid is fed from the water inlet 22 through the water-feed pipe 16 laid in the harness 10 into the case 11, and then flows down along the inner wall of the case 11. When the washing liquid reaches the bottom end of the case 11, it is agitated by the tip 13*a* of the supersonic vibration horn 13. This causes capillary waves in the washing liquid, and thereby the washing liquid is made into fine particles and accelerated, and then flows downward out through the opening of the case 11.

Figure 8:
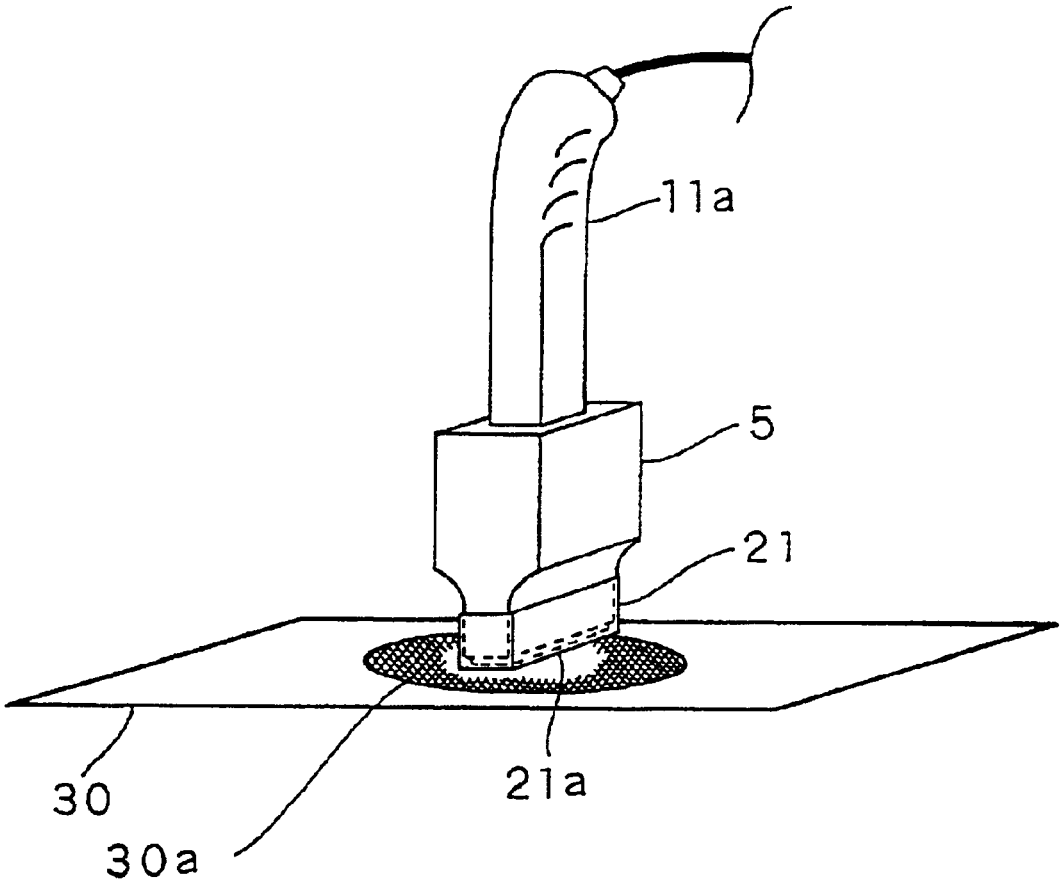
FIG. 8 is a diagram showing how partial washing is performed with the partial washing apparatus of the washing machine having a partial washing apparatus of the second embodiment.

FIG. 8 shows how partial washing is performed with this partial washing apparatus 5. When the user, holding the grip portion 11*a*, presses the tip of the cover 21 onto a soiled portion 30*a* of an article 30 to be washed, the cover 21 is pressed upward. As a result, the tip 13*a* (see FIG. 7) of the supersonic vibration horn 13 and the end surface 21*a* of the cover 21 make contact with the article 30.

The washing liquid agitated by supersonic vibration flows out of the case 11 on to the soiled portion 30*a*, and intense cavitation is caused on the surface and in the fiber of the article 30. Moreover, the article 30, by touching the tip 13*a* of the supersonic vibration horn 13, receives directly therefrom physical vibrating mechanical force. The synergistic effect of these makes highly effective removal of partially deposited dirt of the soiled portion 30*a* possible.

The user determines whether to continue or end partial washing by checking the progress of washing by sight. On completion of partial washing, the article 30 is, as it is, thrown into the washing sink 6 (see FIG. 5) so as to be subjected to ordinary washing subsequently.

In this partial washing apparatus 5, the washing liquid is fed to an article 30 to be washed in the form of mist that barely permeates the article 30, and the feeding of water to the article 30 is achieved inside the cover 21. This helps minimize the splashing around of water. Moreover, the article 30 is put into contact with the tip 13*a* of the supersonic vibration horn 13, and this helps prevent the distance from the article 30 to the tip 13*a* from varying with the way the user performs partial washing. Thus, it is possible to achieve a desired washing effect at all times.

Moreover, when no article 30 is pressed onto the partial washing apparatus 5, the tip 13*a* of the supersonic vibration horn 13 is enclosed in the cover 21. This helps prevent the user's hands from inadvertently touching the tip 13*a* vibrating at a supersonic frequency, and thereby prevents injuries such as burns.

Furthermore, in the partial washing apparatus 5 of this embodiment, the cover 21 has its end surface 21*a* subjected to a friction reduction process as by being coated with a fluorocarbon resin. This ensures smooth sliding of the partial washing apparatus 5 across the soiled portion 30*a,* and also helps reduce damage to the fiber. In addition, the supersonic vibration of the tip 13*a* of the supersonic vibration horn 13 also acts to lessen the resistance due to friction.

Figure 9:
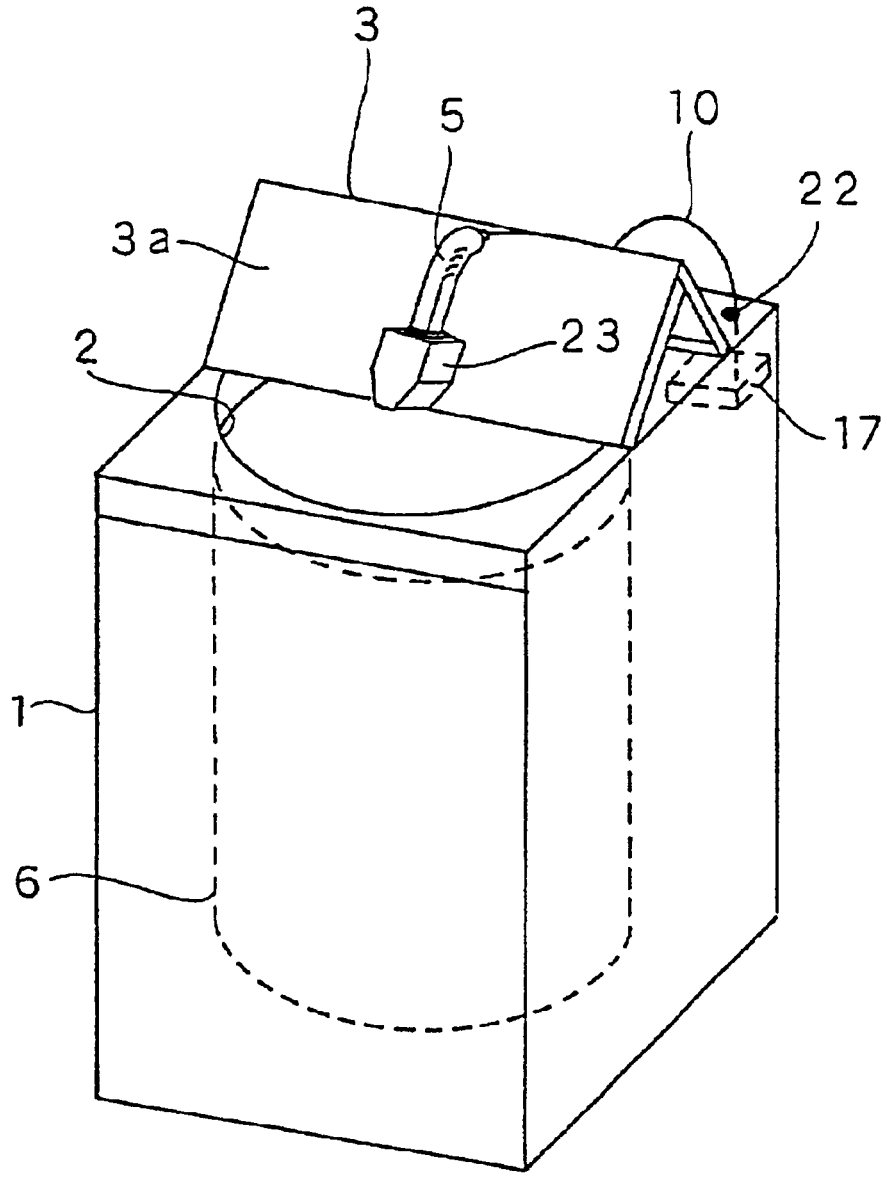
FIG. 9 is a perspective view of the partial washing apparatus of the washing machine having a partial washing apparatus of the second embodiment, in its state fitted to the lid.

FIG. 9 is a perspective view of the partial washing apparatus 5, showing its state when fixed on the washing machine proper 1. The lid 3, is designed to be folded in two when opened. The lid 3 has a bracket member 23 fitted near the front edge thereof, substantially at the lateral center of a front portion 3*a* thereof, i.e. the portion that lies in front when the lid 3 is folded in two.

The lid 3 is so constructed that, as it is opened gradually, when the front edge thereof reaches the position where it lies across a diameter of the washing sink 6, the lid 3 can be locked in that position by a simple mechanism (not shown) using a magnet or other means. This permits the partial washing apparatus 5 to be kept in a fixed operating position. At this time, the partial washing apparatus 5 is located substantially right above the center of the washing sink 6.

Figure 10:
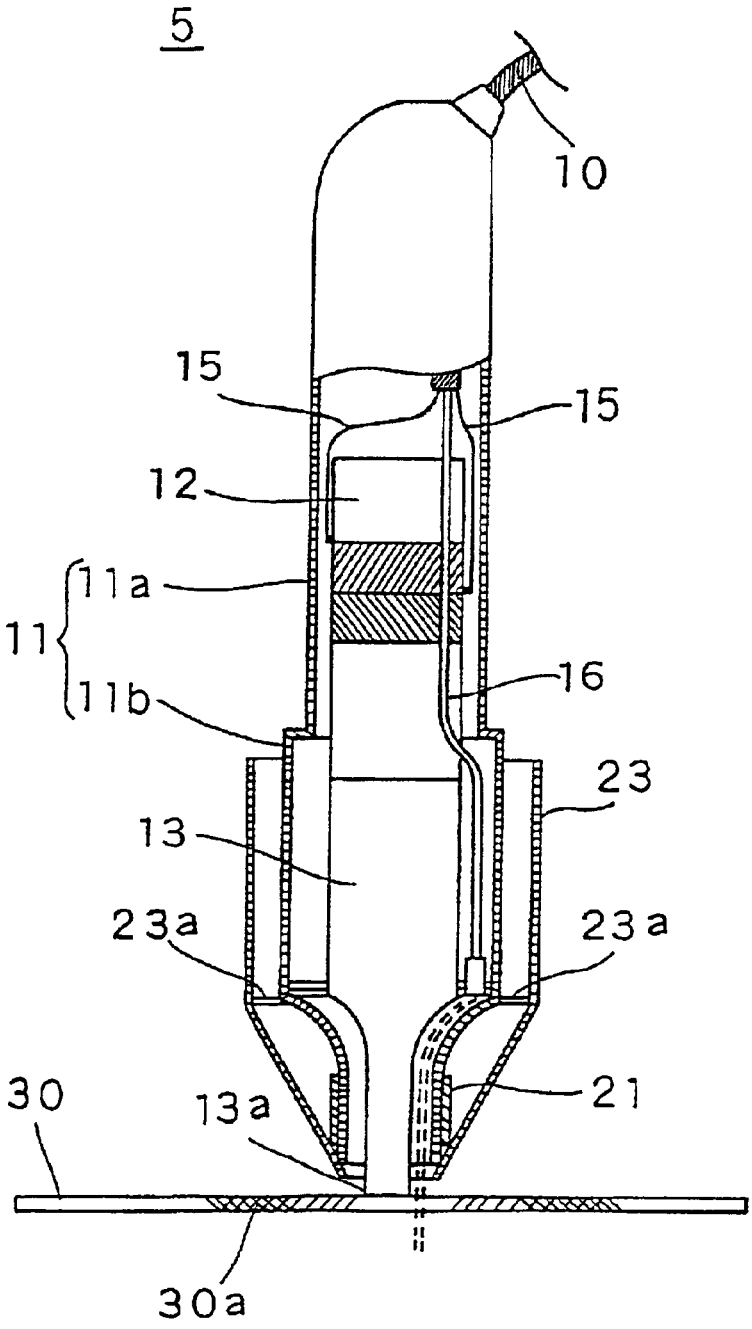
FIG. 10 is a sectional view, as seen from the side, of the partial washing apparatus of the washing machine having a partial washing apparatus of the second embodiment, in its state fitted to the lid.

FIG. 10 is a sectional view of the partial washing apparatus 5 and the bracket member 23, showing their state when partial washing is performed while they are located as described just above. The partial washing apparatus 5 put in the bracket member 23 is supported in a fixed position by a supporting flange 23*a*.

The bracket member 23 has its tip narrowed in the same manner as the case 11, and has an opening formed at the bottom end. This opening formed in the bracket member 23 has a diameter smaller than the opening formed at the tip of the cover 21. Accordingly, when the partial washing apparatus 5 is put in the bracket member 23, the cover 21 is suspended on the inner wall of the bracket member 23, and is thus held in a position raised relative to the case 11. Thus, the tip 13*a* of the supersonic vibration horn 13 is slightly exposed from the opening at the bottom end of the bracket member 23.

The user presses an article 30 to be washed onto the tip 13*a* of the supersonic vibration horn 13 exposed from the bracket member 23, and then slides the article 30 laterally repeatedly. The synergistic effect of the washing liquid agitated by supersonic vibration and the vibrating mechanical force exerted by the tip 13*a* makes highly effective removal of dirt of the soiled portion 30*a* deposited partially on the article 30.

At this time, since the partial washing apparatus 5 is kept in a fixed position on the lid 3, it is kept at a level higher than about 900 mm above the floor, though this level varies from one washing machine to another. This makes it possible to keep the partial washing apparatus at a level higher than with conventional partial washing apparatuses, and thus permits the user to perform partial washing in a more comfortable position with his or her body kept upright.

As described above, the partial washing apparatus 5 of this embodiment can be used both as a handy-type partial washing apparatus when detached from the washing machine proper 1 and as a fixed-type when kept in a fixed position on the washing machine proper 1. When used as a handy-type, this partial washing apparatus is particularly suitable for removal of dirt, such as stains, deposited in the form of scattered dots.

When kept in a fixed position on the washing machine proper 1, the partial washing apparatus 5 is located right above the center of the washing sink 6, i.e. where the opening 2 is widest open. This is particularly convenient when washing a long article as when washing the collar of a shirt. Moreover, this permits the user to use both hands. In this way, it is possible to choose how to use the partial washing apparatus 5 in accordance with the size of the article 30 to be washed and the extent of the soiled portion 30*a*.

Moreover, the bracket member 23 is detachable from the washing machine proper 1, and therefore, when the partial washing apparatus 5 is used as a handy-type, the bracket member 23 can be attached, for example, to the side (see FIG. 5) of the washing machine proper 1. This helps prevent the partial washing apparatus 5 and the bracket member 23 from becoming an obstacle when articles to be washed are put in or taken out through the opening 2 of the washing machine proper 1.

Figure 11:
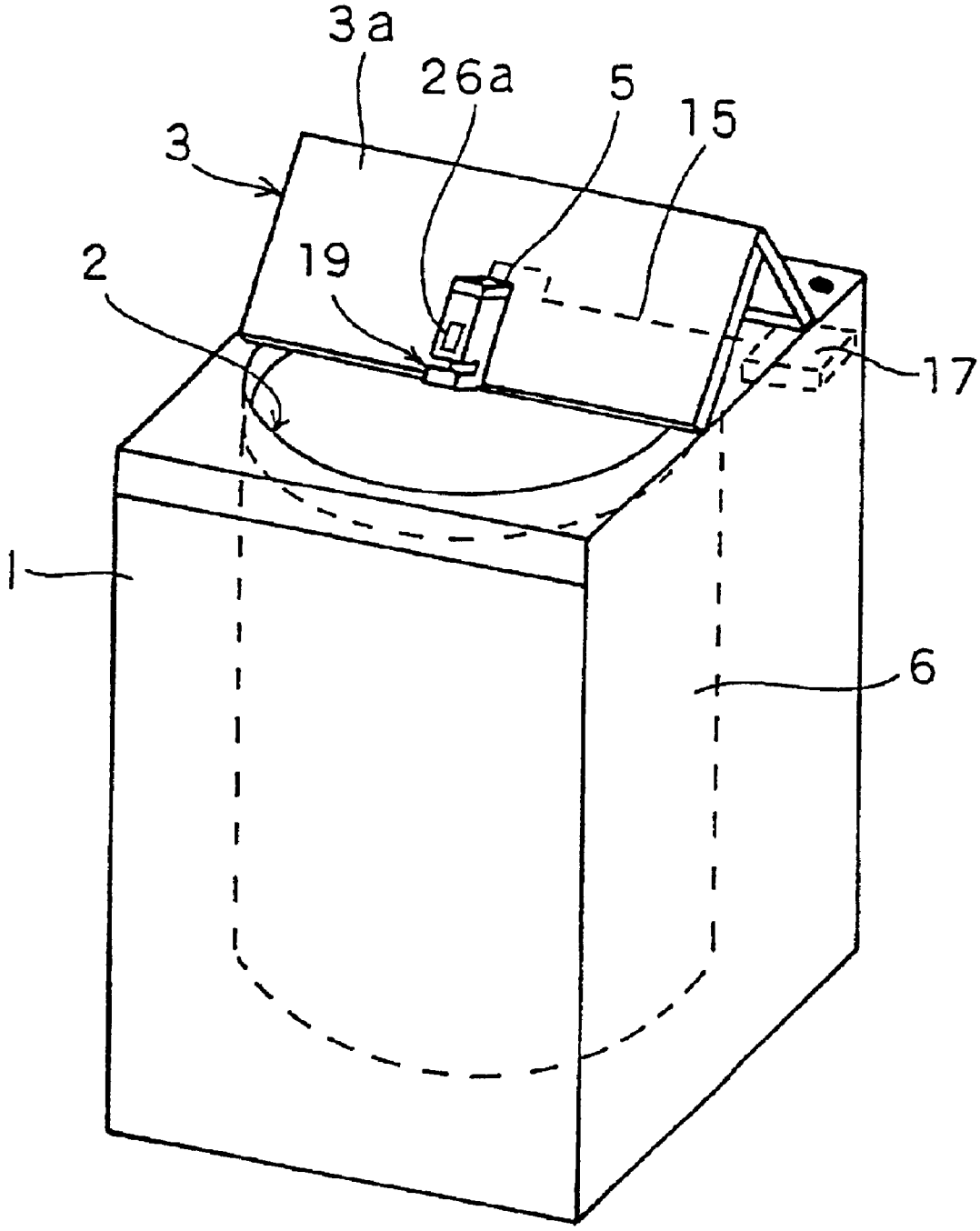
FIG. 11 is a perspective view of the washing machine having a partial washing apparatus of a third embodiment of the invention.

FIG. 11 is a perspective view of the washing machine having a partial washing apparatus of a third embodiment of the invention. As compared with the first embodiment described previously and shown in FIG. 1, the partial washing apparatus 5 of this embodiment is constructed differently, and it is fitted, as in the second embodiment (see FIG. 9), substantially at the lateral center of a lid 3. In this embodiment, the washing liquid is fed from a liquid-feed tank as will be described later, and solid soap can be used as detergent.

Figure 12:
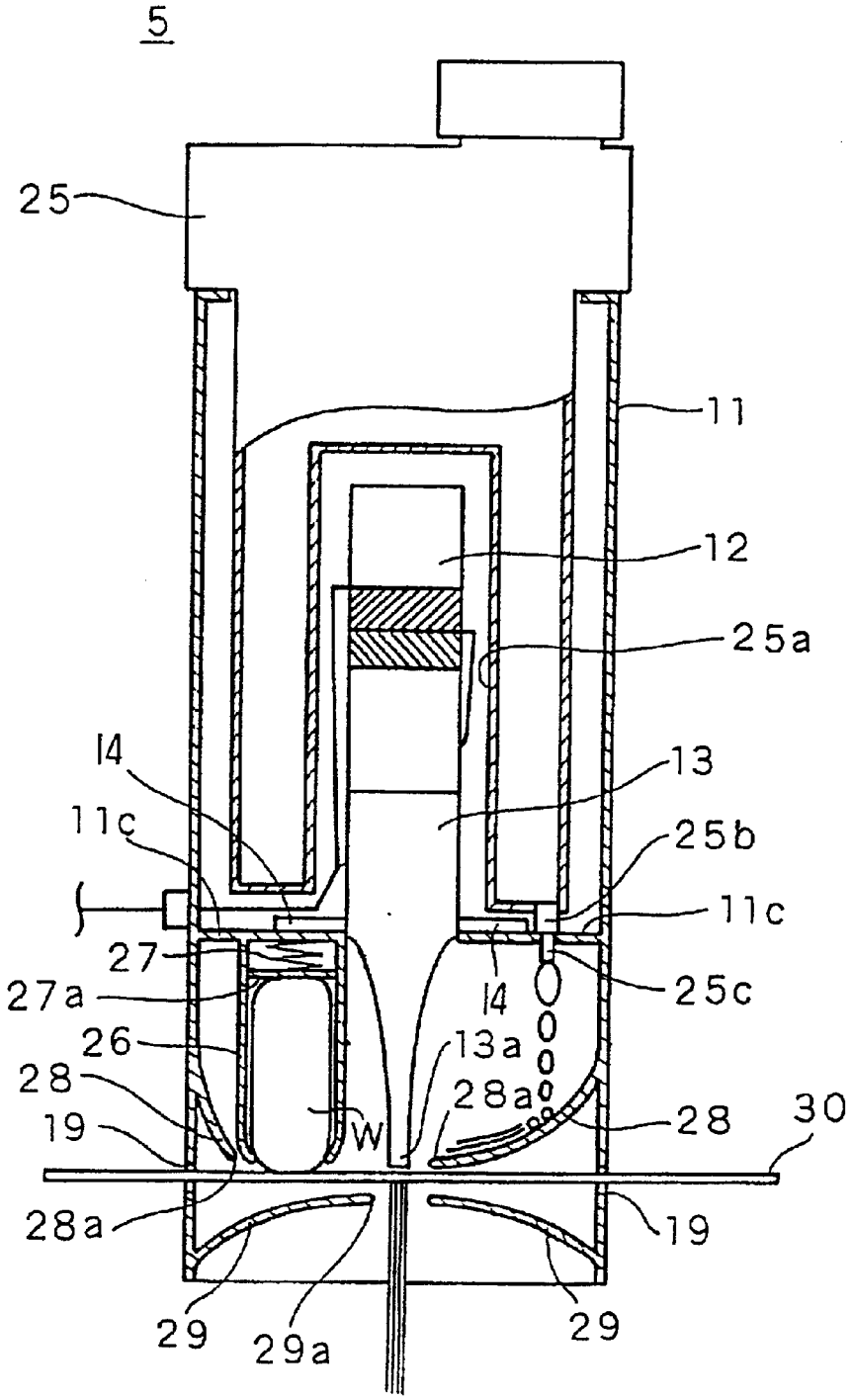
FIG. 12 is a sectional view, as seen from the front, of the partial washing apparatus of the washing machine having a partial washing apparatus of the third embodiment.

FIG. 12 is a sectional view of the partial washing apparatus 5 of this embodiment. The partial washing apparatus 5 has a case 11 having the shape of a rectangular parallelepiped with its top and bottom ends open, and the space inside the case 11 is divided into an upper portion and a lower portion by a separation wall 11*c*. The separation wall 11*c* has an opening formed at the center thereof, and around the rim of this opening is fitted a supporting flange 14 that supports a supersonic vibration horn 13.

A cartridge-type liquid-feed tank 25 is inserted into the case 11 from the top end thereof. The liquid-feed tank 25 is made of a molded resin such as polyethylene or polypropylene. The liquid-feed tank 25 has the shape of a rectangular parallelepiped, and has a recessed portion 25*a* formed in its bottom surface. When the liquid-feed tank 25 is inserted into the case 11, the recessed portion 25*a* prevents the liquid-feed tank 25 from interfering with the supersonic vibration horn 13 and a supersonic resonator 12 mounted on top thereof.

At the bottom end of the liquid-feed tank 25 is provided a tube 25*c* that is connected to the liquid-feed tank 25 through a valve portion 25*b*. The tube 25*c* penetrates the separation wall 11*c,* with its tip placed below the separation wall 11*c*. When the liquid-feed tank 25 is inserted down to a predetermined position inside the case 11, the valve portion 25*b* is pressed onto the separation wall 11*c* and is thereby opened. As a result, the washing liquid inside the liquid-feed tank 25 is emitted out through the tube 25*c*. When the liquid-feed tank 25 is not inserted down to the predetermined position, the valve portion 25*b* remains closed, and thus the washing liquid is not emitted out.

Inside the case 11, below the separation wall 11*c* is provided an upper cover 28 that is so curved as to be convex downward and that has an opening 28*a* formed in a bottom portion thereof. The supersonic vibration horn 13 is arranged with its tip 13*a* located in this opening 28*a* of the upper cover 28, at a level identical with or slightly lower than the opening 28*a*.

Below the upper cover 28 is provided a lower cover 29 that is so curved as to be convex upward and that has an opening 29*a* formed in a top portion thereof. The case 11 has a slit 19 (see FIG. 11) formed therein. Thus, an article 30 to be washed, when inserted into the slit 19, passes through the gap between the upper and lower covers 28 and 29.

Between the separation wall 11*c* and the upper cover 28, a solid soap chamber 26 is provided next to the supersonic vibration horn 13. The solid soap chamber 26 has the bottom end of its side wall bent inward so that a cake of solid soap W stored therein is supported from below. The loading of the solid soap W is achieved through a soap loading window 26*a* (see FIG. 11) that can be opened and closed as required. The solid soap W is exposed from the bottom end of the solid soap chamber 26 so as to be located in the opening 28*a* of the upper cover 28, at a level identical with the tip of the supersonic vibration horn 13.

Moreover, inside the solid soap chamber 26, in an upper portion thereof, a spring 27 and a moving plate 27*a* fixed to one end of the spring 27 are provided as a pressing means. The solid soap W is pressed downward from above by the force applied thereto by the spring 27 through the moving plate 27*a*. Thus, the bottom surface of the solid soap W is kept at a fixed level at all times.

Now, how partial washing is performed with this partial washing apparatus 5 constructed as described above will be described. When the liquid-feed tank 25 filled with a washing liquid such as detergent is inserted down to a predetermined position inside the case 11, the valve portion 25*b* is opened, and the washing liquid is emitted out through the tube 25*c*. The washing liquid flows down along the curved surface inside the upper cover 28, and is thereby guided to the tip 13*a* of the supersonic vibration horn 13. In cases where the washing liquid stored in the liquid-feed tank 25 is detergent, there is no particular need to use the solid soap W, and therefore it is unloaded from the solid soap chamber 26.

On insertion of the liquid-feed tank 25, the supersonic resonator 12 starts vibrating at its resonance frequency in response to a driving signal from an oscillator 17 (see FIG. 11). This vibration is amplified by the supersonic vibration horn 13 so as to agitate the washing liquid. This causes capillary waves in the washing liquid, and thereby the washing liquid is made into fine particles and accelerated, and then flows downward out through the opening 29*a* of the lower cover 29 into the washing sink 6.

The user inserts a soiled portion of an article 30 to be washed into the slit 19 of the case 11, and slides it laterally repeatedly. Thus, the washing liquid agitated by supersonic vibration is fed to the article 30. Moreover, the tip 13*a* of the supersonic vibration horn 13 slightly touches the article 30. Accordingly, the synergistic effect of the washing ability of the washing liquid, the intense cavitation that is caused by the supersonic vibration on the surface and in the fiber of the article 30, and the physical vibrating mechanical force at several tens of kilohertz applied directly to the article 30 makes highly effective removal of partially deposited dirt possible.

The user determines whether to continue or end partial washing by checking the progress of washing by sight. On completion of partial washing, the article 30 is, as it is, thrown into the washing sink 6 so as to be subjected to ordinary washing subsequently.

In this partial washing apparatus 5, as in the first embodiment, the washing liquid is fed to an article 30 to be washed in the form of mist, and its flow rate is as low as about 0.1 liters per minute. Therefore, even if the washing liquid is brought close to the article 30, it barely permeates it, and does not splash around. Considering that the washing liquid is fed at a flow rate of about 0.1 liters per minute, if the liquid-feed tank 25 has a capacity of about 1 liter, partial washing can be continued for sufficient duration of about 10 minutes.

Moreover, due to dielectric loss, the supersonic resonator 12 becomes as hot as 60 to 70° C. Since the liquid-feed tank 25 is so arranged as to surround the supersonic resonator 12, the heat conducted or radiated from the supersonic resonator 12 keeps warm the washing liquid stored in the liquid-feed tank 25. This helps achieve an increased washing effect.

Moreover, the construction in which an article 30 to be washed is inserted into the slit 19 of the case 11 prevents the user's hands from touching the tip 13*a*, and thereby achieves high safety as in the first embodiment. If the slit 19 is given a gap of, for example, about 10 mm, whereas it prevents inadvertent insertion of the user's hands or fingers, it permits smooth insertion of articles to be washed that most frequently need partial washing, such as collars and cuffs of shirts, socks, undershirts, and other underclothes, without causing undue inconvenience.

Moreover, the distance from the article 30 slid in the slit 19 to the tip 13*a* of the supersonic vibration horn 13 is fixed. This permits different users to perform partial washing under the same conditions and thus with a constant washing effect.

Moreover, the partial washing apparatus 5 of this embodiment uses supersonic vibration in a relatively low frequency range. Thus, the vibration waves obtained do not exhibit beam-like concentration as with supersonic vibration in a high frequency range. Accordingly, the supersonic vibration obtained by agitating water is not transmitted with high intensity to the liquid continuously flowing down, and therefore, even if the washing liquid flowing down into the washing sink 6 touches the user's hands, the user feels no sore.

Next, how partial washing is performed using solid soap W will be described. When no detergent is in stock that can be put into the liquid-feed tank 25 for partial washing, plain water is poured into the liquid-feed tank 25, and a cake of solid soap W as is commonly used in an ordinary household is inserted into the solid soap chamber 26.

The solid soap W is exposed from the bottom end of the solid soap chamber 26 so that its bottom surface is kept at a level identical with the tip 13*a* of the supersonic vibration horn 13. Thus, when a soiled portion of an article 30 to be washed is inserted into the slit 19 and slid laterally repeatedly, the solid soap W is applied to the article 30.

The water emitted from the liquid-feed tank 25 is agitated by supersonic vibration as described previously, and is fed to the article 30 to which the soap has already been applied. Moreover, the tip 13*a* of the supersonic vibration horn 13 slightly touches the article 30. Thus, the synergistic effect of the washing ability of the soap, the intense cavitation that is caused by the water agitated by the supersonic vibration on the surface and in the fiber of the article 30, and the physical vibrating mechanical force at several tens of kilohertz applied directly to the article 30 makes highly effective removal of partially deposited dirt possible.

Meanwhile, the water thus fed washes the soap away from the article 30, but, since the solid soap W is applied newly as the article 30 is slid repeatedly, the washing effect does not lessen. Moreover, as the solid soap W is consumed, the spring 27 and the moving plate 27*a* keep it pressed onto the bottom end of the solid soap chamber 26, and therefore the exposed portion of the solid soap W is kept at a level identical with the tip 13*a* of the supersonic vibration horn 13 at all times.

Figure 13:
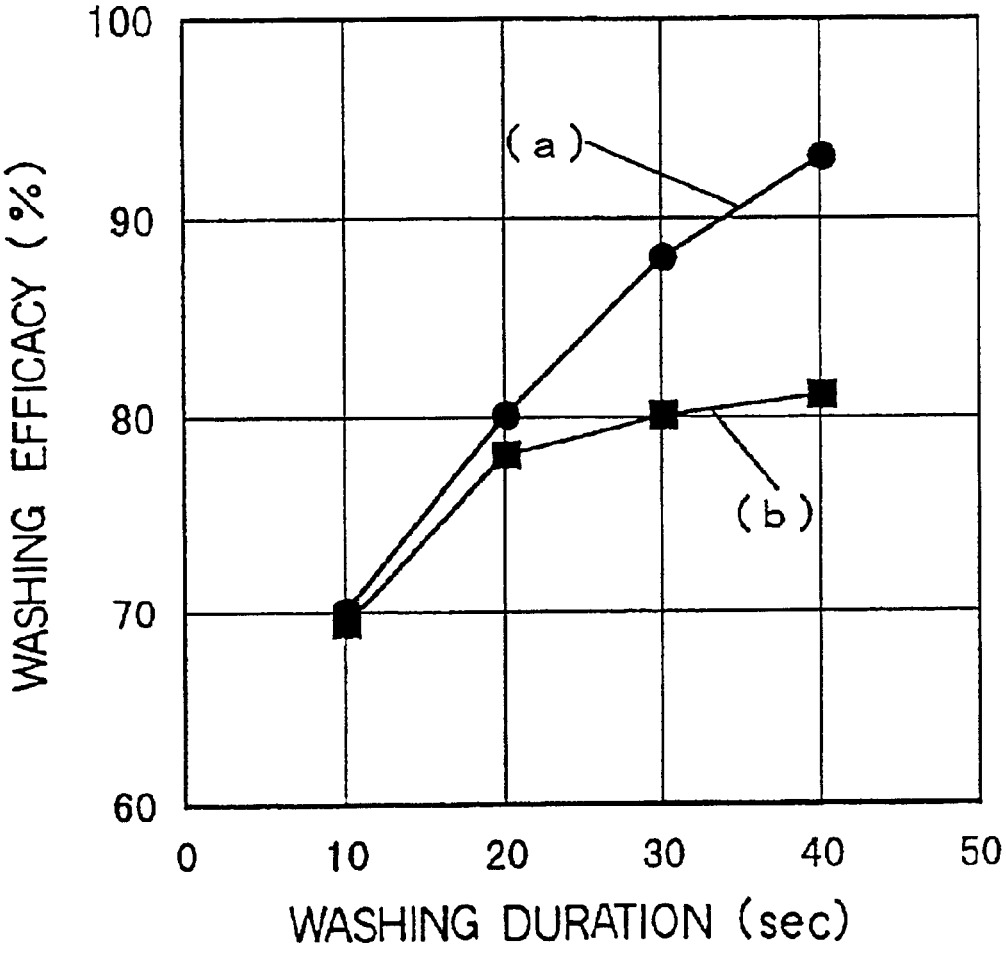
FIG. 13 is a diagram showing the results of washing tests conducted with the partial washing apparatus of the washing machine having a partial washing apparatus of the first embodiment.

FIG. 13 shows the results of cloth washing tests actually conducted with the partial washing apparatus 5 of this embodiment. Here, the tests were conducted in the same manner as described earlier. In this figure, the graph (a) represents the results of washing in which the liquid-feed tank 25 was filled with a commercially available liquid detergent for general washing diluted to a standard-use concentration, and the graph (b) represents the results of washing in which a commercially available liquid detergent for partial washing was applied beforehand to artificially soiled cloths and plain water was poured into the liquid-feed tank 25.

FIG. 13 shows the following. In the case (b), the water washes the detergent away and thereby lowers its concentration. Thus, the washing efficacy does not show any significant improvement after certain washing duration. On the other hand, in the case (a), the washing liquid is fed constantly, and therefore the washing efficacy continues to improve as the washing duration becomes longer. Thus, partial washing can be performed more effectively in the case (a). Moreover, after washing, no damage due to friction is observed in the artificially soiled cloths as would be observed if they were washed with a brush or by hand rubbing.

Figure 14:
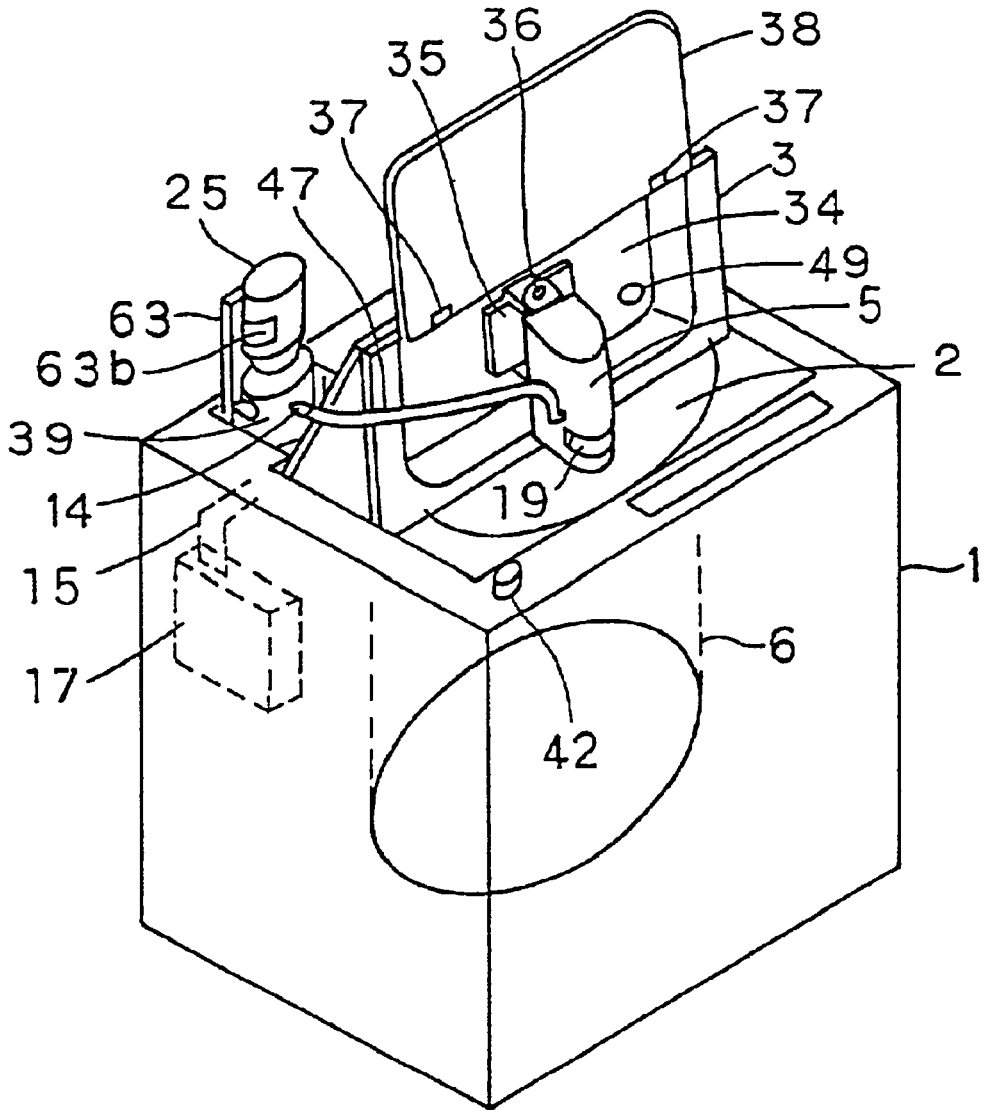
FIG. 14 is a perspective view of the washing machine having a partial washing apparatus of a fourth embodiment of the invention.

FIG. 14 is a perspective view of the washing machine having a partial washing apparatus of a fourth embodiment of the invention. In this embodiment, as in the third embodiment, the partial washing apparatus 5 is fitted substantially at the lateral center of the outer surface of a front portion of a lid 3. The lid 3 is so constructed that, when it is opened, by being folded in two, up to substantially the center of the top-end opening of a washing sink 6, the lid 3 can be locked at that position by a simple mechanism using a magnet (not shown).

In a rear portion of the top surface of the washing machine proper 1, a liquid-feed tank 25 and a pumping device 39 are provided. Here, the liquid-feed tank 25 is interchangeable among a plurality of liquid-feed tanks filled with different washing liquids. When performing partial washing, the user selects one of the liquid-feed tanks 25 that is filled with the washing liquid most suitable for the article that is going to be washed, and fits it in position.

Figure 15:
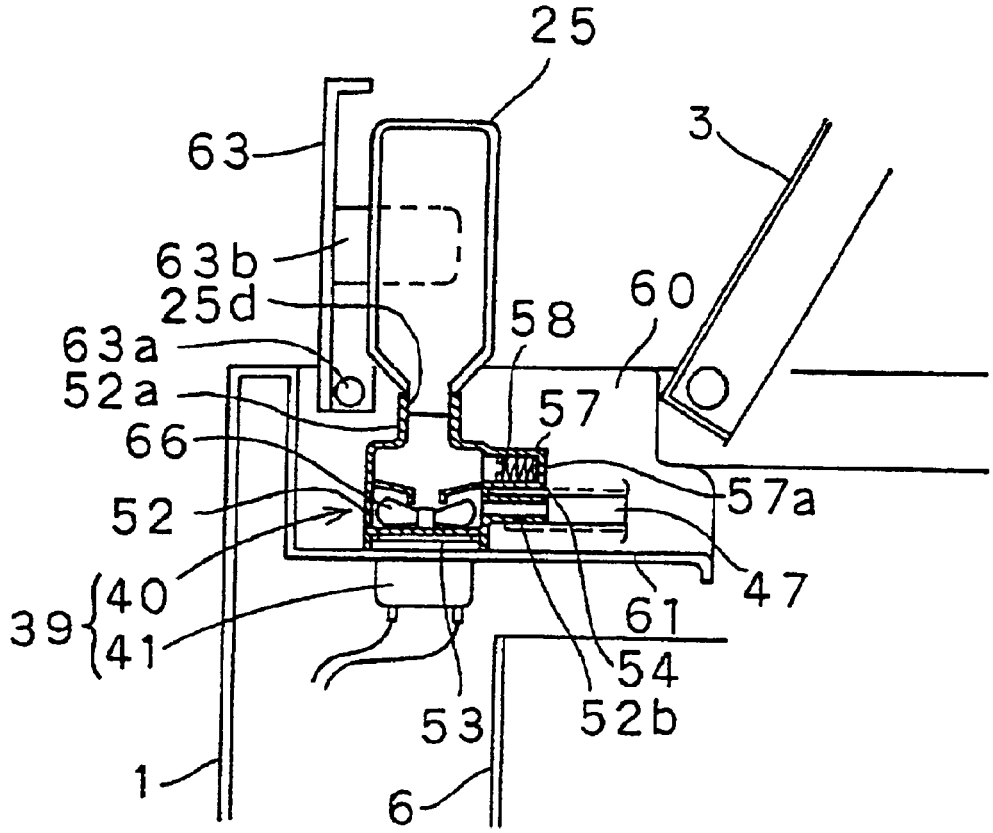
FIG. 15 is a sectional view, as seen from the side, of a portion, where the liquid-feed tank is fitted, of the washing machine having a partial washing apparatus of the fourth embodiment.

FIG. 15 shows the pumping device 39 in more detail. The pumping device 39 is composed of a pump portion 40 and a motor portion 41. The pump portion 40 is enclosed in a cylindrical housing 52 that communicates with the liquid-feed tank 25. In a lower portion inside the housing 52 is provided a pump 66, which is driven by the motor portion 41 to discharge the washing liquid fed thereto from the liquid-feed tank 25 through a discharge portion 52*b*.

The liquid-feed tank 25 has the shape of a bottomed cylinder, and has a cylindrical outlet 25*d* formed at its top end. The outer circumferential surface of the outlet 25*d* is threaded so as to form screw ridges. The housing 52 of the pump portion 40 has a cylindrical inlet 52*a* formed at its top end. The inner circumferential surface of the inlet 52*a* is threaded so as to form screw grooves that engage with the screw ridges formed on the outer circumferential surface of the outlet 25*d* of the liquid-feed tank 25.

The pump portion 40 is, in its inverted state, fixed to the liquid-feed tank 25, with the inlet 52*a* of the former screw-engaged with the outlet 25*d* of the latter. Here, the pump 40 serves as a lid of the liquid-feed tank 25.

Figure 16:
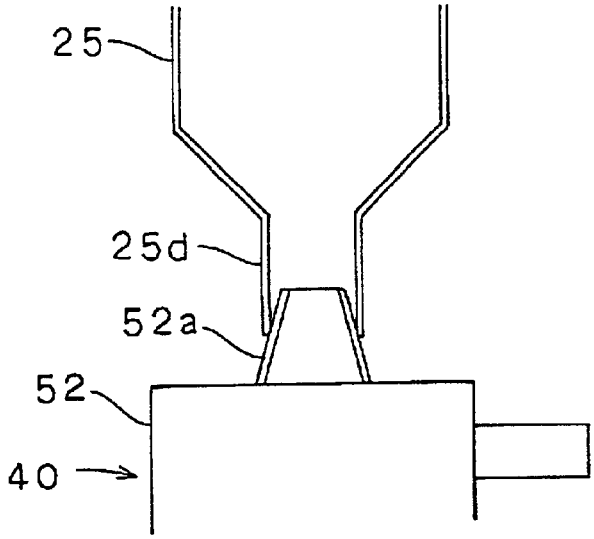
FIG. 16 is a diagram schematically showing how the liquid-feed tank is fitted to the washing machine having a partial washing apparatus of the fourth embodiment.

The liquid-feed tank 25 and the pump portion 40 may be coupled together in any other way than is specifically described above. For example, as shown in FIG. 16, it is also possible to form the inlet 52*a* of the pump portion 40 into a tapered shape so that its outer diameter continuously decreases upward, and engage the outer circumferential surface of this inlet 52*a* with the outlet 25*d* of the liquid-feed tank 25. This makes it possible to cope with different types of liquid-feed tank 25 having different outlet diameters, and thus offers a high practical value.

Figure 17:
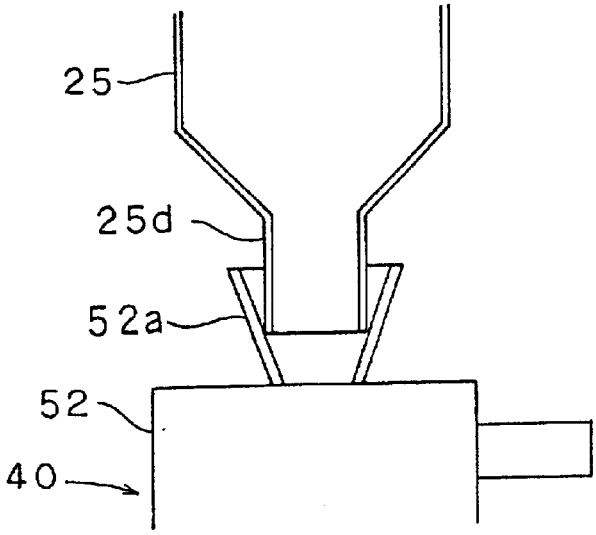
FIG. 17 is a diagram schematically showing how the liquid-feed tank is fitted to the washing machine having a partial washing apparatus of the fourth embodiment.

Alternatively, as shown in FIG. 17, it is also possible to form the inlet 52*a* of the pump portion 40 into a tapered shape so that its inner diameter continuously increases upward, and engage the inner circumferential surface of this inlet 52*a* with the outlet 25*d* of the liquid-feed tank 25. This achieves the same effect as described above.

Figure 18:
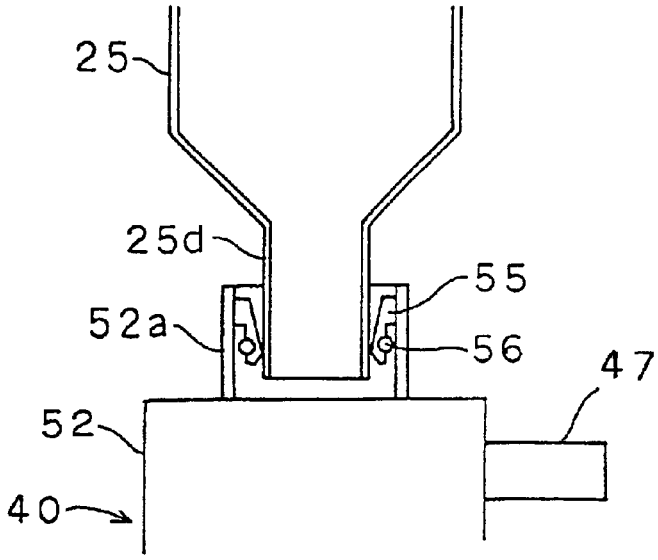
FIG. 18 is a diagram schematically showing how the liquid-feed tank is fitted to the washing machine having a partial washing apparatus of the fourth embodiment.

Alternatively, as shown in FIG. 18, it is also possible to fit around the inner circumferential surface of the inlet 52*a* of the pump portion 40, a cylindrical gasket 55 made of an elastic material such as rubber and fitted with a ring-shaped spring 56 around it. In this example, when the outlet 25*d* of the liquid-feed tank 25 is inserted into the inlet 52*a,* the gasket 55 is expanded radially outward by the outlet 25*d*.

Figure 19:
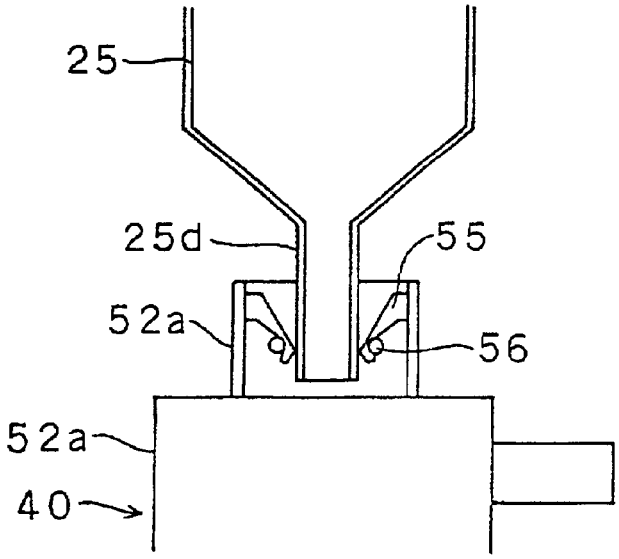
FIG. 19 is a diagram schematically showing how the liquid-feed tank is fitted to the washing machine having a partial washing apparatus of the fourth embodiment.

As a result, the gasket 55 is pressed onto the outer circumferential surface of the outlet 25*d* by the spring 56, and thereby the liquid-feed tank 25 is held in position. As shown in FIG. 19, this construction permits even a liquid-feed tank 25 with an outlet 25*d* having a smaller diameter to be held in position.

In FIG. 15, the pumping device 39 employs a DC motor of a magnet-coupled type. That is, the pump portion 40 and the motor portion 41 are detachably coupled together by magnetic force exerted by a magnet surface 53. Here, the DC motor operates from a direct-current 12 V source, and can thus be supplied with electric power from a 12 V source for a bath-water pump or the like. This helps simplify control circuitry and improve safety.

In the housing 52 of the pump portion 40, a check valve 54 is provided to balance the decompression that occurs in the liquid-feed tank 25. The check valve 54 is provided inside a cylindrical portion 57 that is formed so as to protrude sideways from the side surface of the housing 52. In FIG. 15, the check valve 54 is pressed rightward by a spring 58 arranged coaxially therewith. In the tip-end surface of the cylindrical portion 57, an opening 57*a* having a diameter smaller than the inner diameter of the cylindrical portion 57 is formed so as to face the check valve 54.

While the washing liquid is being discharged from the liquid-feed tank 25, the decompression that occurs in the liquid-feed tank 25 compresses the spring 58 and thus the check valve 54 moves leftward. This causes the opening 57 to be opened, and thus outside air is introduced into the housing 52. As a result, the pressure inside the housing 52 is kept at about the normal pressure. On the other hand, when the discharging of the washing liquid is stopped, the check valve 54 is pressed onto the opening 57*a* by the force exerted by the spring 58, and thereby leakage of the liquid is prevented. This eliminates the need to perform some operation to stop leakage of the liquid manually.

Here, the check valve 54 is provided in the pump portion 40 that serves also as the lid of the liquid-feed tank 25, and therefore there is no need to provide a check valve in the liquid-feed tank 25. Thus, quite conveniently, it is possible to use any container as the liquid-feed tank 25 as long as it can engage with the inlet 52*a* of the pump portion 40.

The motor portion 41 of the pumping device 39 is fixed on the bottom floor 61 of a recessed portion 60 formed behind the lid 3. To the discharge portion 52*b* formed on the housing 52 of the pumping device 39, a liquid-dispensing pipe 47 is connected which is at the other end connected to the partial washing apparatus 5 (see FIG. 14). Arranging the motor portion 41 behind the lid 3 in this way helps prevent the liquid-feed tank 25 from becoming an obstacle when partial washing is performed, or when the lid 3 is opened or closed, or when the user operates an operation panel (not shown) provided on the top surface of the washing machine proper 1.

The motor portion 41 is fitted in such a way that the magnet surface 53 lies above the bottom floor 61 of the recessed portion 60. This permits easy fitting of the pump portion 40, and thereby prevents troubles such as misalignment, imperfect fitting, or imperfect contact and thus malfunctioning thereof. Moreover, it is easy to clean the magnet surface 53 as by removing foreign objects or the like attracted thereto. It is to be noted, however, that the magnet surface 53 can be cleaned easily even if it is arranged level with the bottom floor 61.

The use of the pumping device 39 of a magnet-coupled type permits the pump portion 40 and the motor portion 41 to be separated completely from each other. This helps enhance the safety when the partial washing apparatus 5 is stored as will be described later and simplify the construction of the pumping device 39. Moreover, the liquid-feed tank 25 can be attached in position simply by putting the pump portion 40 on the magnet surface 53, and the liquid-feed tank 25 can be detached simply by lifting up the pump portion 40. This ensures easy attachment and detachment of the liquid-feed tank 25.

At the top of the recessed portion 60, near the rear end thereof, a protection cover 63 for opening and closing the opening to the recessed portion 60 is fitted so as to be rotatable about a horizontal shaft 63*a*. The protection cover 63 has a holder 63*b* for supporting the liquid-feed tank 25 formed integrally therewith.

When partial washing is performed, the protection over 63 is held upright so that the holder 63*b* holds the liquid-feed tank 25. This permits the liquid-feed tank 25 to be held upright. Forming the holder 63*b* integrally with the inner surface of the protection cover 63 in this way helps simplify the construction. When partial washing is not performed, the protection cover 63 is brought down to close the opening to the recessed portion 60 and thereby protect the magnet surface 53 of the motor portion 41.

In FIG. 14, the partial washing apparatus 5 is fitted in a recessed portion 34 formed in the outer surface of the lid 3 through a holding fixture 35. The holding fixture 35 has a hinge mechanism 36, which allows the partial washing apparatus 5 to rotate through 90° about a vertically extending axis. This permits the partial washing apparatus 5 to rotate between a state as shown in FIG. 14 in which it protrudes from the recessed portion 34 and a state as shown in FIG. 20 in which it is housed inside the recessed portion 34 with the lid 3 closed.

Moreover, as in the embodiment described previously, reference numeral 17 represents an oscillator for generating an electric pulse signal for driving supersonic vibration, and reference numeral 15 represents electric leads for transmitting the driving signal generated by the oscillator 15 to the partial washing apparatus 5. Reference numeral 42 represents a power switch for turning the partial washing apparatus 5 on and off. It is to be noted that this switch 42 is not necessary in cases where automatic switching is adopted whereby the partial washing apparatus 5 is turned on automatically on detection by a sensor of an article to be washed.

Figure 20:
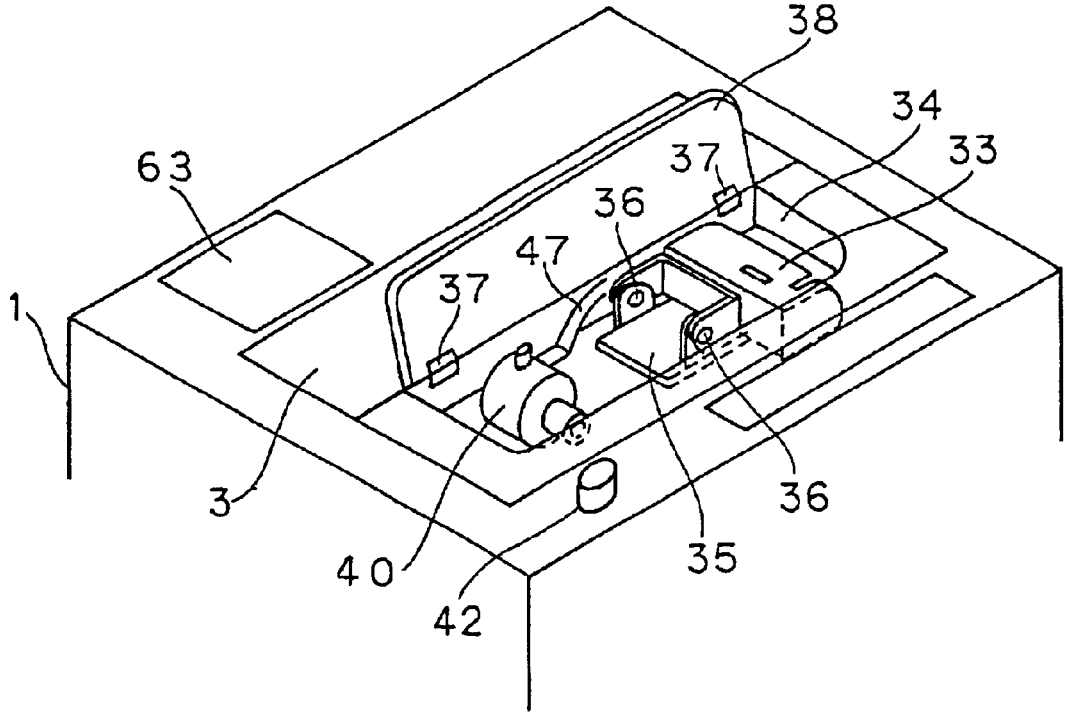
FIG. 20 is a perspective view showing how the pump portion is housed in the washing machine having a partial washing apparatus of the fourth embodiment.

Moreover, in FIG. 20, when the partial washing apparatus 5 is housed inside the recessed portion 34, a space is left in the left-hand portion of the recessed portion 34. In this space, the liquid-dispensing pipe 47 connected to the partial washing apparatus 5 and the pump portion 40 connected thereto are housed. This allows the partial washing apparatus 5, the liquid-dispensing pipe 47, and the pump portion 40 to be handled as a single unit, and thus makes their disassembly and arrangement easy. Moreover, the motor portion 41 is separable, and this enhances safety.

Normally, the lid 3 is designed to be easy to open and close. Therefore, fitting the partial washing apparatus 5 on the lid 3 makes it easy to set up the partial washing apparatus 5 for use. Moreover, the lid 3 is an independent member that is pivoted on the washing machine proper 1, and therefore fitting the partial washing apparatus 5 on the lid 3 makes it possible to fit the lid 3 together with the partial washing apparatus 5 to a plurality of types of washing machine having different heights. This makes diversification of a product line easy.

At the top of the recessed portion 34, at the rear end thereof, an openable cover 38 for opening and closing the opening to the recessed portion 34 is rotatably fitted through a pair of hinges 37 and 37. The openable cover 38 is fitted so as to be level with the top surface of the lid 3 when closing the opening to the recessed portion 34. This prevents an article to be washed or other object from being caught on the openable cover 38. Moreover, the openable cover 38 is so constructed that an object placed thereon does not impose a load on the partial washing apparatus 5 housed inside the recessed portion 34.

Figure 21:
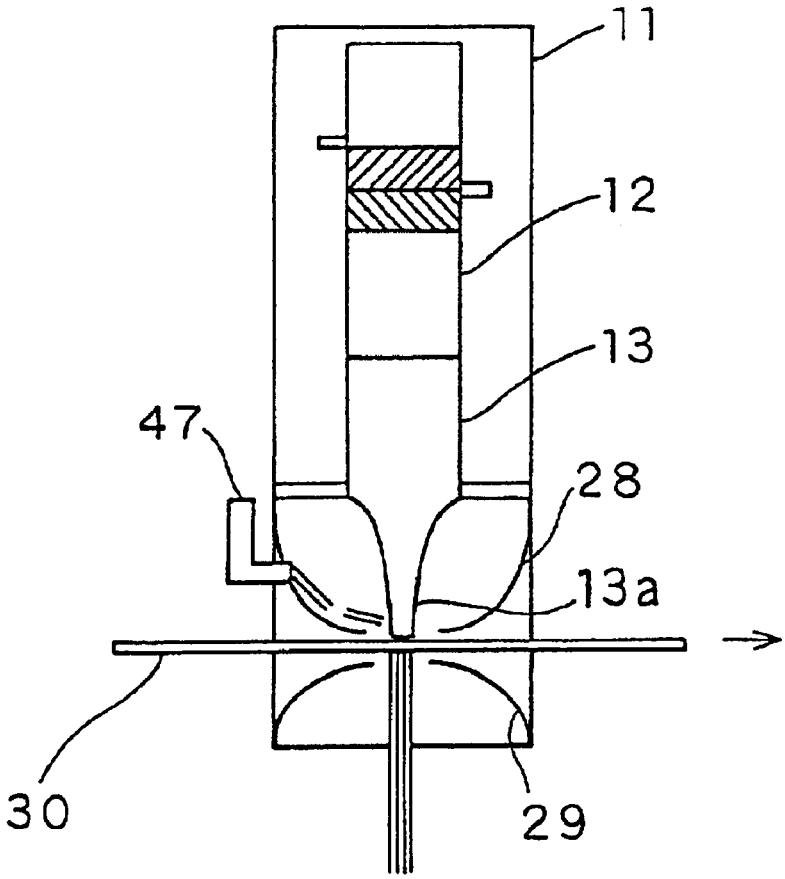
FIG. 21 is a sectional view, as seen from the front, of the partial washing apparatus of the washing machine having a partial washing apparatus of the forth embodiment.

As shown in FIG. 21, the partial washing apparatus 5 has a supersonic resonator 12 and a supersonic vibration horn 13 enclosed in a case 11. In the case 11, a slit 19 (see FIG. 14) is formed near the tip 13*a* of the supersonic vibration horn 13 to permit insertion of an article 30 to be washed.

Inside the case 11, an upper cover 28 is formed that is so curved as to be convex downward and that has an opening formed in a bottom portion thereof, and, below this upper cover 28, a lower cover 29 is formed that is so curved as to be convex upward and that has an opening formed in a top portion thereof. The upper and lower covers 28 and 29 serve to guide the article W inserted into the slit 19 in the feed direction (indicated by an arrow).

On the side surface of the case 11, the liquid-dispensing pipe 47 is detachably fitted, which is at the other end connected to the pumping device 39 so as to communicate therewith. The washing liquid fed in through the liquid-dispensing pipe 47 is guided by the upper cover 28 to the tip 13*a* of the supersonic vibration horn 13.

Now, how this partial washing apparatus constructed as described above operates will be described. First, a liquid-feed tank 25 filled with the detergent most suitable for an article 30 to be washed is selected, and then the openable cover 38 of the lid 3 is opened and the pump portion 40 is taken out. Then, the inlet 52*a* of the pump portion 40 is engaged with the outlet 25*d* of the liquid-feed tank 25 so that the pump portion 40 is fixed to the liquid-feed tank 25.

Then, the lid 3 is rotated upward while being folded in two so as to be locked near the center of the opening 2 to the washing sink 6. Then, the partial washing apparatus 5 housed inside the recessed portion 34 of the lid 3 is rotated forward through 90° so that the partial washing apparatus 5 protrudes from the recessed portion 34 as shown in FIG. 14.

Next, the protection cover 63 provided in a rear-end portion of the top surface of the washing machine proper 1 is rotated upward so as to stand upright. Then, the liquid-feed tank 25, to which the pump portion 40 has already been fitted, is inverted upside down so that, as shown in FIG. 15, the pump portion 40 is coupled and thereby fixed to the magnet surface 53 of the motor portion 41. Moreover, the liquid-feed tank 25 is supported by the holder 63*b* provided on the inner surface of the protection cover 63.

When the pump portion 40 is coupled to the motor portion 41, the motor portion 41 drives the pump 66. As a result, the washing liquid that has flown down out of the liquid-feed tank 25 into the pump 40 is fed through the liquid-dispensing pipe 47 to the tip 13*a* of the supersonic vibration horn 13 of the partial washing apparatus 5.

A soiled portion of the article 30 is inserted into the slit 19 of the partial washing apparatus 5, and the power switch is turned on. Then, the supersonic resonator 12 generates supersonic vibration, and this vibration is amplified by the supersonic vibration horn 13. Then, as the article 30 is slid in the direction indicated by the arrow in FIG. 21, the washing liquid agitated by supersonic vibration is applied to the soiled portion, and thereby partial washing is achieved.

Here, the partial washing apparatus 5 may be so designed that, as soon as the power switch 42 is turned on, the motor portion 41 of the pumping device 39 starts being driven. This makes it possible to feed the washing liquid to the tip 13*a* of the supersonic vibration horn 13 as soon as the partial washing apparatus 5 starts being operated. This helps prevent the partial washing apparatus 5 from being operated idly to become abnormally hot, and also helps simplify the operation thereof.

When partial washing of the article 30 is finished, the liquid-feed tank 25 and the pump portion 40 are detached from the washing machine proper 1. Then, the pump portion 40 is detached from the liquid-feed tank 25, and is, together with the liquid-dispensing pipe 47 and the partial washing apparatus 5, housed in the recessed portion 34. Here, the washing liquid that remains in the liquid-dispensing pipe 47 flows out naturally, and therefore there is no risk of it freezing up in winter. Moreover, as shown in FIG. 14, a drain hole 49 is provided in the recessed portion 34, and therefore the washing liquid spilled within the recessed portion 34 naturally flows out into the washing sink 6.

With the washing machine having a partial washing apparatus of this embodiment, quite conveniently, there is no need to apply detergent for partial washing beforehand to every soiled portion of articles 30 to be washed. Moreover, there is no possibility of detergent being washed away from a portion to be washed, and in addition it is possible to use a detergent most suitable for a given type of article to be washed. This helps achieve effective washing with a minimal amount of detergent.

Moreover, it is possible to mount selectively one among a plurality of liquid-feed tanks 25 filled with different washing liquids (for example, detergent for cotton articles, detergent for woolen articles, and detergent for oil stains). This permits the user to select the washing liquid most suitable for a given type of article to be washed and a given degree of soil and thereby achieve the optimal washing effect in partial washing.

Moreover, there is no need to keep such washing liquids as are not frequently used (for example, detergent for woolen articles and detergent for oil stains) ready for use at all times; that is, it is necessary to have only the most frequently used washing liquid (for example, detergent for cotton articles) ready for use. This helps prevent infrequently used washing liquids from being dried and solidified.

Moreover, since one among a plurality of liquid-feed tanks 25 is selectively mounted, it is necessary to secure space only for arranging one liquid-feed tank that is actually used. This helps save space. Moreover, the use of the pumping device 39 of a magnet-coupled type makes attachment and detachment of the liquid-feed tank 25 easy. Furthermore, when partial washing is not performed, the liquid-feed tank 25 and the pump portion 40 are detached from the motor portion 41, and therefore it is necessary to secure space only for arranging the motor portion 41 in the washing machine proper 1. This helps save space.

Figure 22:
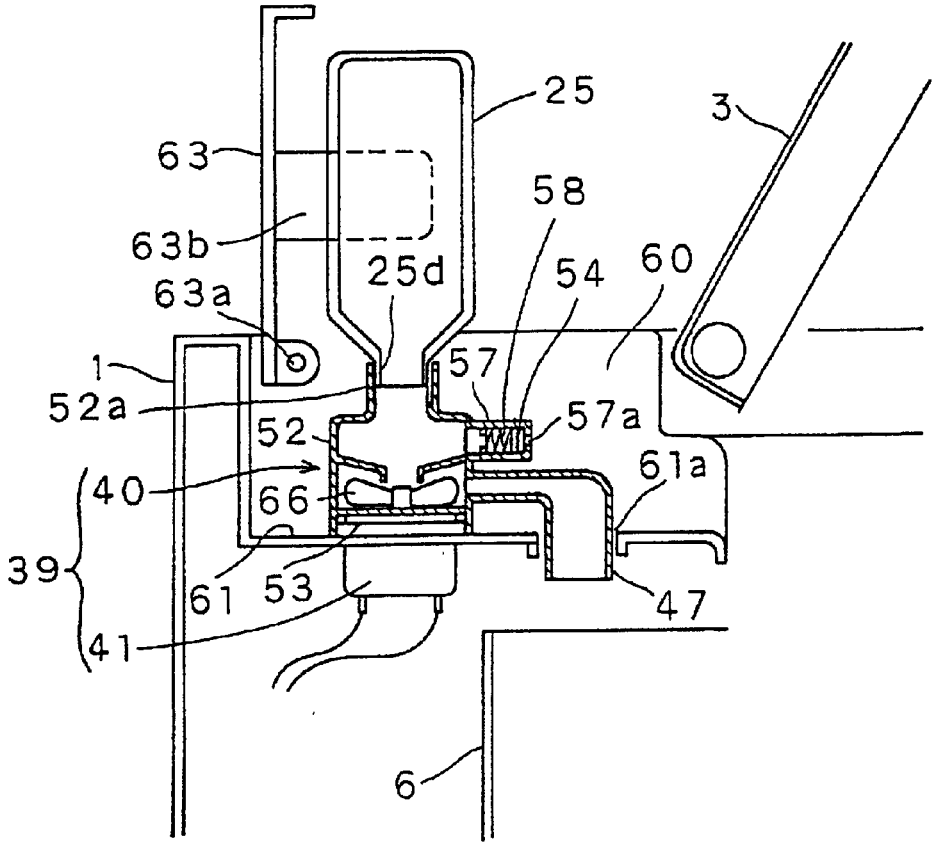
FIG. 22 is a sectional view, as seen from the side, of a portion, where the liquid-feed tank is fitted, of the washing machine of a fifth embodiment of the invention.

FIG. 22 is a sectional view of a principal portion of the washing machine of a fifth embodiment of the invention. In this embodiment, as compared with the washing machine having a partial washing apparatus of the fourth embodiment shown in FIG. 15, the partial washing apparatus 5 provided therein is omitted. Here, the washing liquid is fed from the pumping device 39 through the liquid-dispensing pipe 47 to the washing sink 6. In other respects, the washing machine of this embodiment is constructed in the same manner as that of the fourth embodiment. In the following descriptions, such components as are found also in the fourth embodiment are identified with the same reference numerals.

Now, how the washing machine of this embodiment operates will be described. First, a liquid-feed tank 25 filled with the washing liquid suitable for an article to be washed is selected, and the inlet 52*a* of the pump portion 40 is engaged with the outlet 25*d* of this liquid-feed tank 25 so that the pump portion 40 is fitted to the liquid-feed tank 25.

Next, the protection cover 63 provided in a rear-end portion of the top surface of the washing machine proper 1 is rotated upward so as to stand upright. Then, the liquid-feed tank 25, to which the pump portion 40 has already been fitted, is inverted upside down so that the pump portion 40 is coupled and thereby fixed to the magnet surface 53. Moreover, the liquid-feed tank 25 is supported by the holder 63*b* provided on the inner surface of the protection cover 63.

When the pump portion 40 and the motor portion 41 are coupled together, the motor portion 41 drives the pump 66. As a result, the washing liquid that has flown down out of the liquid-feed tank 25 into the pump portion 40 is fed through the liquid-dispensing pipe 47 into the washing sink 6 so as to be used to wash the article.

In this embodiment, as in the fourth embodiment, it is possible to mount selectively one among a plurality of liquid-feed tanks 25, and therefore it is possible to select and feed the most suitable one among a plurality of different washing liquids in accordance with the type of article to be washed. This makes effective washing of an article to be washed possible.

Moreover, there is no need to keep such washing liquids as are not frequently used (for example, detergent for woolen articles and detergent for oil stains) ready for use at all times; that is, it is necessary to have only the most frequently used washing liquid (for example, detergent for cotton articles) ready for use. This helps prevent infrequently used washing liquids from being dried and solidified.

Moreover, since one among a plurality of liquid-feed tanks 25 is selectively mounted, it is necessary to secure space only for arranging one liquid-feed tank that is actually used. This helps save space. Moreover, the use of the pumping device 39 of a magnet-coupled type makes attachment and detachment of the liquid-feed tank 25 easy. Furthermore, when partial washing is not performed, the liquid-feed tank 25 and the pump portion 40 are detached from the motor portion 41, and therefore it is necessary to secure space only for arranging the motor portion 41 in the washing machine proper 1. This helps save space.

Figure 23:
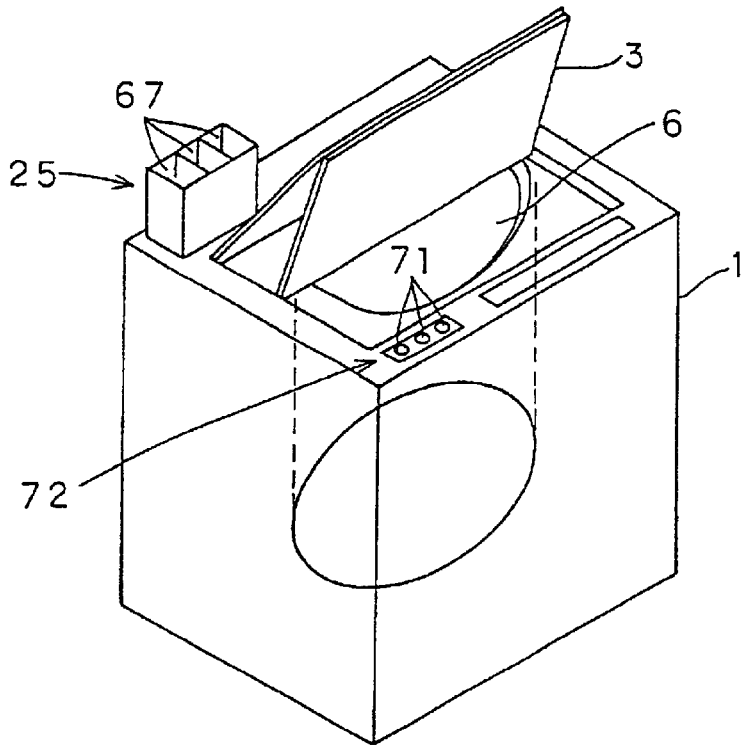
FIG. 23 is a perspective view of the washing machine of a sixth embodiment of the invention.

FIG. 23 is a perspective view of the washing machine of a sixth embodiment of the invention. In this embodiment, as compared with the fifth embodiment described previously and shown in FIG. 22, the liquid-feed tank 25 is constructed differently. In other respects, the washing machine of this embodiment is constructed in the same manner as that of the fifth embodiment. In the following descriptions, such components as are found also in the fifth embodiment are identified with the same reference numerals.

Figure 24:
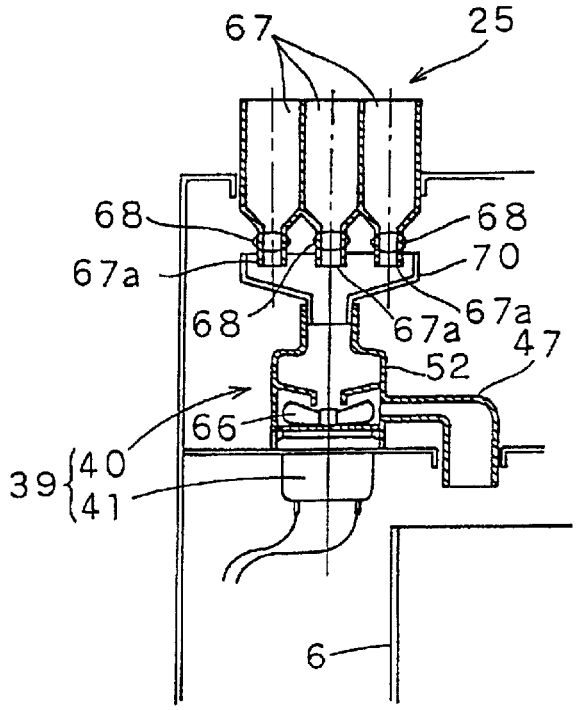
FIG. 24 is a sectional view, as seen from the side, of a portion, where the liquid-feed tank is fitted, of the washing machine of the sixth embodiment.

In a rear portion of the top surface of the washing machine proper 1, a liquid-feed tank 25 and a pumping device 39 are provided. The liquid-feed tank 25 has three reservoirs 67 arranged laterally for storage of different washing liquids. For example, the reservoirs 67 are filled individually with detergent for cotton articles, detergent for woolen articles, and detergent for oil stains. As shown in FIG. 24, the reservoirs 67 have cylindrical detergent outlets 67*a* formed individually at their respective bottom ends, and those detergent outlets 67*a* are individually provided with solenoid valves 68.

Each detergent outlet 67*a* is connected through a funnel-shaped detergent drip pan 70 to the pumping device 39 so as to communicate therewith. As in the fourth and fifth embodiments, the pumping device 39 is composed of a pump portion 40 and a motor portion 41, and the pump portion 40 is enclosed in a cylindrical housing 52 that communicates with the detergent drip pan 70 at the bottom thereof.

In a lower portion inside the housing 52, a pump 66 is arranged, and, on the side of the housing 52, a liquid-dispensing pipe 47 is provided so as to protrude sideways therefrom. The liquid-dispensing pipe 47 has its end bent downward so as to face the opening to the washing sink 6. In the pumping device 39, the motor portion 41 drives a pump 66 so that the washing liquid emitted from the liquid-feed tank 25 is fed through the liquid-dispensing pipe 47 into the washing sink 6.

In a front portion of the top surface of the washing machine proper 1, an input device 72 having three detergent selection keys 71 is provided. These detergent selection keys 17 permit entry of information specifying one of the reservoirs 67. In accordance with this information, a controller (not shown) opens the solenoid valve 68 of the specified reservoir 67 and drives the pumping device 39. As a result, the detergent selected by the user is fed into the washing sink 6.

In this embodiment, as in the fourth and fifth embodiment, when performing washing, the user can select and feed the most suitable one among a plurality of different washing liquids stored individually in detergent feeding means in accordance with the type of article to be washed. This makes effective washing of an article to be washed possible.

Moreover, the washing machine of this embodiment may be additionally provided with one of the partial washing apparatuses of the first to fourth embodiments described previously to make it possible to perform partial washing using one among a plurality of detergents. Moreover, the constructions of the fourth to sixth embodiments, in which a washing liquid is fed from a liquid-feed tank 25, can be applied not only to washing machines for clothes but also to other washing apparatuses; for example, those constructions can be applied to face wash/makeup stands to permit partial washing of clothes thereon.

Figure 25:
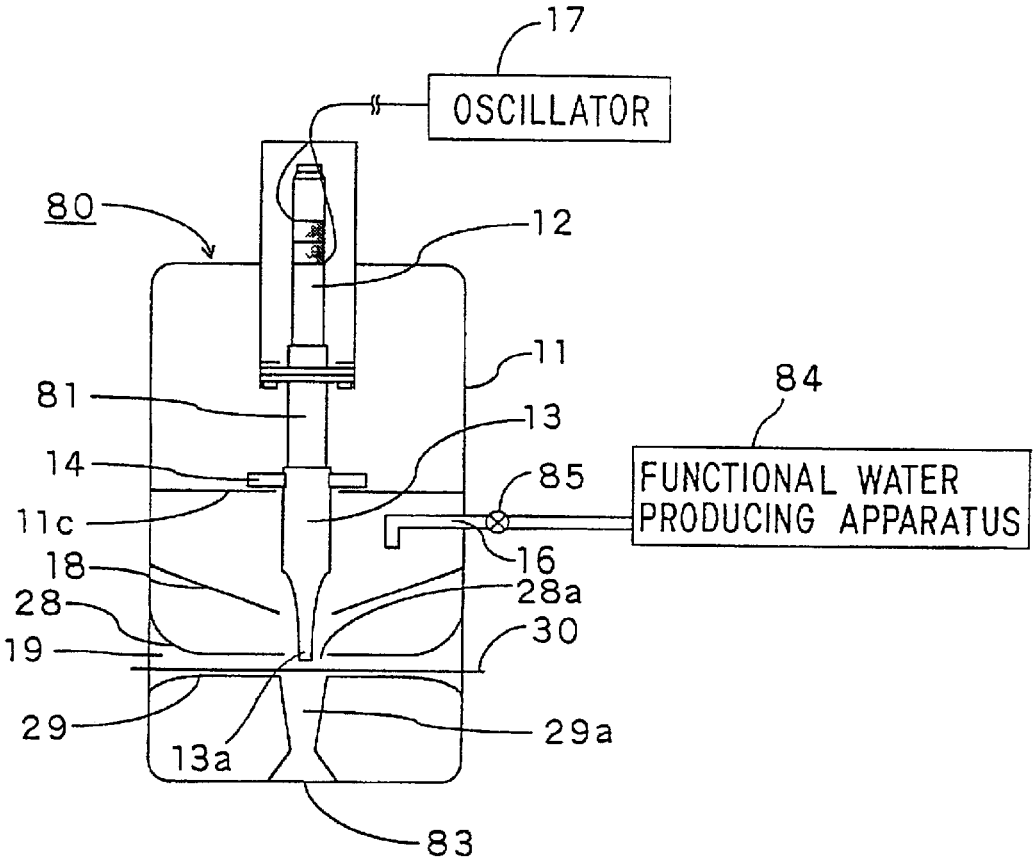
FIG. 25 is a sectional view, as seen from the front, of the supersonic washing machine of a seventh embodiment of the invention.

FIG. 25 is a sectional view, as seen from the front, of the supersonic washing apparatus of a seventh embodiment of the invention, showing its construction. The supersonic washing apparatus 80 is enclosed in a case 11 having a slit 19. The slit 19 is formed between an upper cover 28 and a lower cover 29 that are formed integrally with the case 11.

Inside the case 11 are arranged a supersonic resonator 12 that generates supersonic vibration in response to a driving signal received from an oscillator 17 and a supersonic vibration horn 13 that amplifies the supersonic vibration, which are coupled together with a cone 81 disposed between them. Through the side wall of the case 11, a water-feed pipe 16 is introduced into the case 11 so as to feed a washing liquid near the tip 13*a* of the supersonic vibration horn 13.

The supersonic vibration horn 13 is disposed through a doughnut-shaped separation wall 11*c* formed inside the case 11, and is kept in a fixed position inside the case 11 by a supporting flange 14 in such a way that the tip 13*a* of the supersonic vibration horn 13 is substantially level with the bottom surface of the upper cover 28.

The lower cover 29 has an opening 29*a* formed below the tip 13*a* of the supersonic vibration horn 13. This opening 29*a* communicates with a drain outlet 83 formed to prompt the draining of the washing liquid. The upper cover 28 has an opening 28*a* formed substantially in a central portion thereof. This opening 28*a* extends in the direction of the depth of the case 11, and is so sized as to allow the tip 13*a* of the supersonic vibration horn 13, which vibrates as the supersonic resonator 12 is driven, to be put therethrough.

The water-feed pipe 16 is connected to a functional water producing apparatus 84, with a flow-rate adjustment valve 85 provided on the way. The flow of the washing liquid fed in through the water-feed pipe 16 is guided by a guide portion 18 that is provided on the inner circumferential surface of the case 11 so as to incline downward toward a somewhat upper portion of the tip 13*a* of the supersonic vibration horn 13.

Now, how this supersonic washing apparatus 80 constructed as described above operates will be described. First, on receiving a driving signal from the oscillator 17, the supersonic resonator 12 starts oscillating at its resonance frequency. Since the supersonic resonator 12 is connected through the cone 81 to the supersonic vibration horn 13 that amplifies vibration, the vibration of the supersonic resonator 12 is amplified by the supersonic vibration horn 13.

The tip 13*a* of the supersonic vibration horn 13 vibrates with an amplitude several times to several tens of times that of the supersonic resonator 12, though the actually obtained amplitude varies with the material and shape of the supersonic vibration horn 13. Here, the vibration energy transmitted from the supersonic resonator 12 is made to converge by the supersonic vibration horn 13, and therefore the local energy density at the tip 13*a* of the supersonic vibration horn 13 is so high as to readily exceed several tens of watts per square centimeter.

At the same time, the washing liquid produced by the functional water producing apparatus 84 is fed in through the water-feed pipe 16. The washing liquid is guided by the guide portion 18 so as to be fed to a side portion of the supersonic vibration horn 13. The washing liquid then flows down, in a uniform current, from the side portion of the supersonic vibration horn 13 to the tip 13*a* thereof, where the washing liquid receives intense vibration. This causes capillary waves in the washing liquid, and thereby the washing liquid is made into fine particles and emitted vigorously downward.

When, at this time, an article 30 to be washed, such as an article of clothing, having detergent applied beforehand to a soiled portion thereof is inserted into the slit 19, the soiled portion is brought close to or into slight contact with the tip-end surface of the supersonic vibration horn 13. Then, while the article 30 is being slid laterally repeatedly, a jet of the washing liquid is emitted from the tip 13*a* of the supersonic vibration horn 13 to the article 30, and simultaneously supersonic vibration is applied to the article 30.

Thus, the intense supersonic vibration at several tens of kilohertz amplified by the supersonic vibration horn 13 is transmitted to the article 30, and this causes intense cavitation on the outer surface or in the fiber of the article 30 soaked with the washing liquid. This makes highly effective removal of dirt possible. Moreover, the liquid waste after washing is promptly drained through the opening 29*a* and the drain outlet 83. The user can check the progress of washing by sight, and thus, in accordance with such checking, the user can determine whether to continue or end washing. This permits the user to save electric power and obtain an adequate washing effect.

Figure 26:
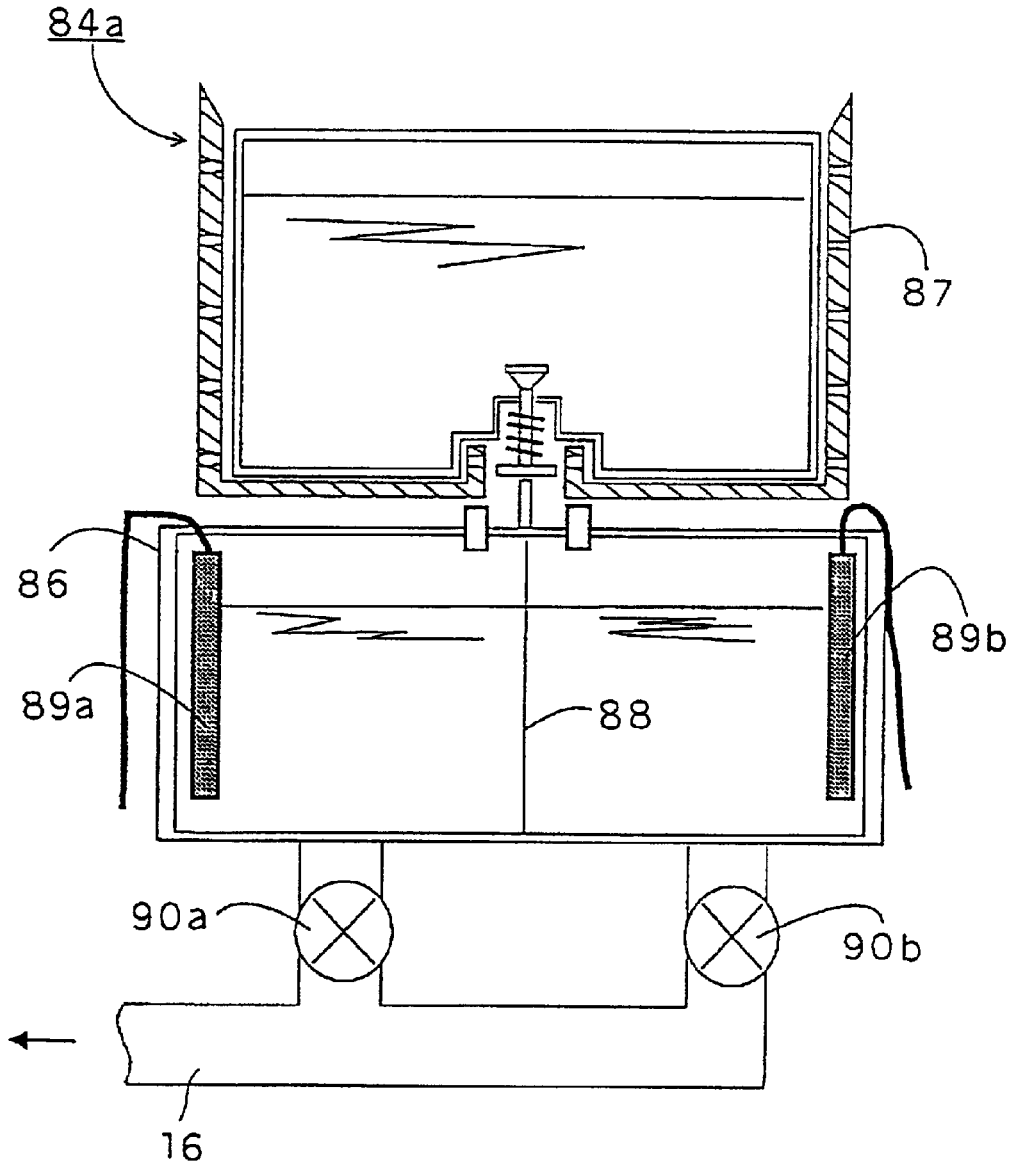
FIG. 26 is a diagram showing the construction of the electrolyzed water producing apparatus of the supersonic washing machine of the seventh embodiment.

Next, the functional water produced by the functional water producing apparatus 84 will be described. The functional water producing apparatus 84 alters various properties of tap water. FIG. 26 is a diagram showing the construction of the functional water producing apparatus 84 of this embodiment. The functional water producing apparatus 84 is realized as an electrolyzed water producing apparatus 84*a*.

As shown in FIG. 26, the electrolyzed water producing apparatus 84*a* has an electrolytic bath 86 for producing alkaline-ion and acidic-ion water by electrolyzing tap water. Above the electrolytic bath 86, a water-supply cartridge 87 is detachably arranged so as to supply the electrolytic bath 86 with tap water as required.

The space inside the electrolytic bath 86 is divided into an anode region and a cathode region by a separation diaphragm 88 that is semipermeable. The electrolytic bath 86 is filled with water, and an electric power is applied between electrodes 89*a* and 89*b* so that the water is electrolyzed. As a result, alkaline-ion water and acidic-ion water are produced separately in the cathode region and in the anode region, respectively.

The two types of ion water thus obtained are then fed to a liquid-feed pipe 16 through pipes that are provided so as to extend downward from the anode and cathode regions of the electrolytic bath 86 and that are regulated by flow-rate adjustment valves 90*a* and 90*b*. Thus, when washing is performed, only one 90*a* of the flow-rate adjustment valves is opened so that alkaline-ion water is fed as a washing liquid to the supersonic washing apparatus 80. Thereafter, the flow-rate valve 90*a* is closed and instead the flow-rate valve 90*b* is opened so that acidic-ion water is fed as a rinsing liquid.

Next, the results of washing tests conducted with the supersonic washing apparatus 80 of this embodiment will be presented. These tests were conducted to examine the washing efficacy achieved by the use of alkaline-ion water produced by the electrolyzed water producing apparatus 84*a* and its effect on the amount of detergent needed. The tests were conducted under the following conditions:

| | |
|---|---|
| Frequency of the supersonic resonator: | 60 kHz |
| Output of the supersonic resonator: | 28 W |
| Detergent: | |
| "PRECARE (a transliteration of a registered trademark in Japan) for collar/cuff stains" manufactured by LION CORPORATION | |
| Standard amount of detergent: | 5 mL/100 $cm^2$ |
| Temperature of the washing liquid: | 25° C. |
| Washing duration: | 10 seconds |

Moreover, as articles to be washed, three artificially soiled cloths conforming to JIS (Japanese Industrial Standard) were used in each of three tests conducted with different amounts of detergent; that is, in each of those tests, washing was performed three times to determine the washing efficacy each time, and then the average washing efficacy was calculated. The results of these tests are shown in Table 1. For comparison, Table 1 shows also the results of washing tests conducted by washing artificially soiled cloths under the same conditions except that, as the washing liquid, unprocessed tap water was used instead of alkaline-ion water.

As will be clear from Table 1, using alkaline-ion water increases the solubility of the detergent in the washing liquid, and thus enhances the action of the surface-active agent. As a result, when alkaline-ion water is used in washing, it is possible to maintain high washing efficacy (about 80%) even if the amount of detergent is reduced to one third. By contrast, when unprocessed tap water is used, it is possible to achieve as high washing efficacy as with alkaline-ion water if a standard amount of detergent is used, but the washing efficacy lowers markedly as the amount of detergent is reduced, becoming as low as 60% with one third of the standard amount of detergent.

Accordingly, by using, as a washing liquid, alkaline-ion water obtained by electrolyzing tap water, it is possible to reduce greatly the amount of detergent needed. This makes it possible to realize a supersonic washing apparatus that helps minimize the adverse effects of detergents on the environment. Moreover, using acidic-ion water in rinsing after sufficient washing makes effective sterilization of washed articles such as clothes possible. Furthermore, the flow of acidic-ion water keeps the whole water-feed system hygienic.

Figure 27:
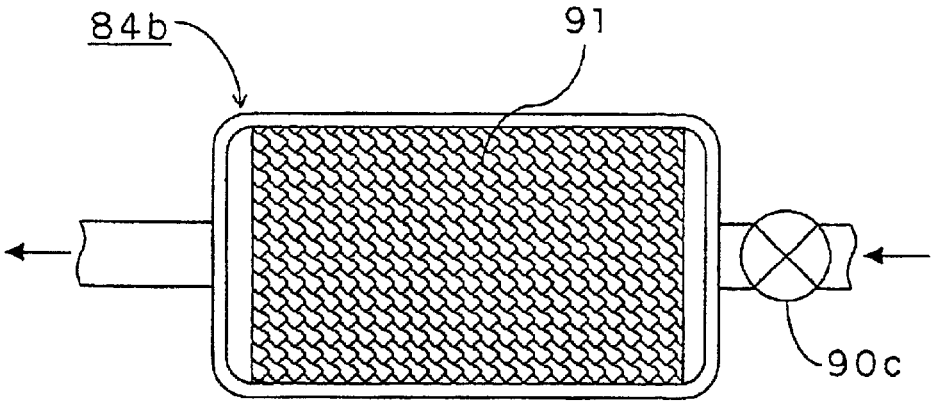
FIG. 27 is a diagram showing the construction of the water softening apparatus of the supersonic washing machine of an eighth embodiment of the invention.

FIG. 27 is a diagram showing the construction of the functional water producing apparatus 84 of the supersonic washing apparatus of an eighth embodiment of the invention. The supersonic washing apparatus of this embodiment has the same overall construction as that of the seventh embodiment shown in FIG. 25, and is different therefrom only in that the functional water producing apparatus 84 here is realized as a water softening apparatus 84*b*.

In FIG. 27, arrows indicate the flow of the washing liquid, and the upstream end of the piping is connected to a faucet (not shown) of tap water. The water softening apparatus 84*b* is composed of an ion-exchange column 91 filled with a cation-exchange resin. On the upstream side of the ion-exchange column 91 is arranged a flow-rate adjustment valve 90*c* for adjusting the flow rate of tap water.

When the flow-rate adjustment valve 90*c* is opened, tap water passes through the ion-exchange column 91, and meanwhile part of the hard contents of the water (mainly sulfates and hydrogencarbonates of calcium and magnesium ions) is removed by the ion-exchange resin. Here, by appropriately adjusting the flow rate of tap water using the flow-rate adjustment valve 90*c*, sufficient removal of the hard contents of the water is possible.

Next, the results of washing tests conducted with the supersonic washing apparatus 80 of this embodiment using, as a washing liquid, water obtained by removing hard contents from tap water as described above will be presented. Table 2 shows the test results, which show the relationship between the hardness of the washing liquid and the washing efficacy. These tests were conducted under the same conditions as those conducted in connection with the seventh embodiment. For comparison, Table 2 shows also the results of tests conducted under the same conditions except that, as the washing liquid, unprocessed tap water was used without removing hard contents therefrom.

As will be clear from Table 2, when tap water is used as a washing liquid, the washing efficacy remains below 80%. By contrast, as the hardness of the washing liquid decreases, the washing efficacy increases, becoming close to 90% at water hardness 15. This could be attributed to an increase in the solubility of the detergent in the washing liquid as a result of the removal of hard contents from water. This enhances the action of the surface-active agent, and thus makes it possible to achieve a sufficient washing effect with a minimal amount of detergent.

The water softening apparatus 84*b* used in this embodiment may be used in combination with the electrolyzed water producing apparatus 84*a* (see FIG. 27) described previously in connection with the seventh embodiment. This helps further reduce the amount of detergent needed.

Figure 28:
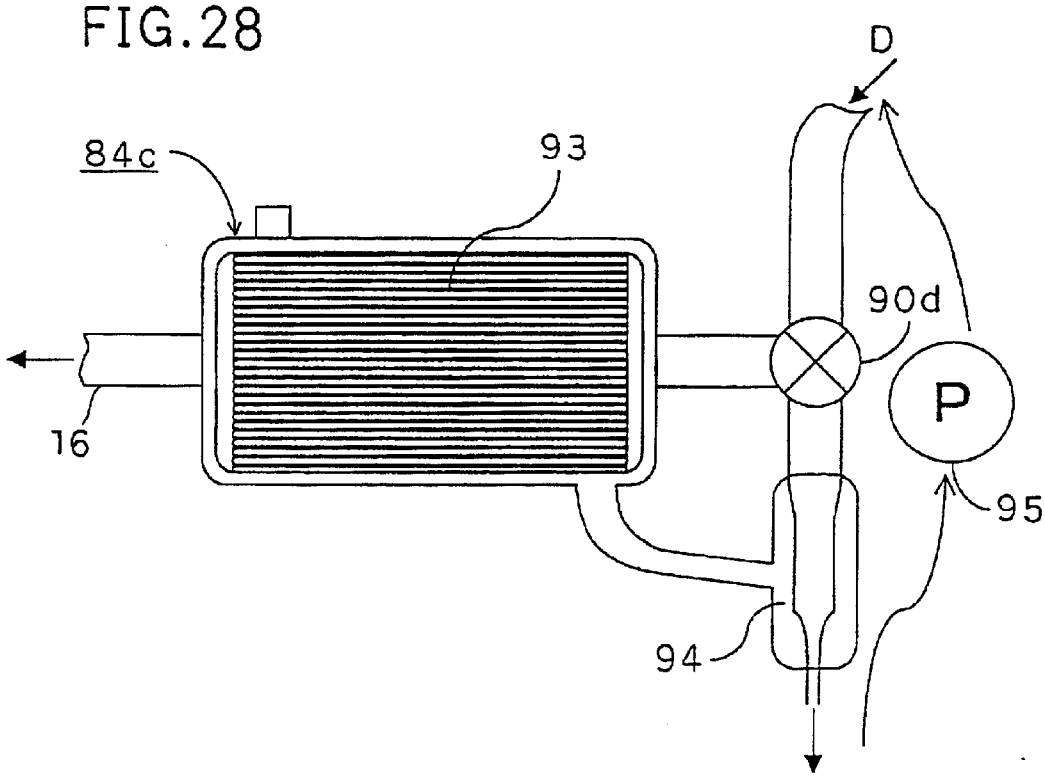
FIG. 28 is a diagram showing the construction of the deaerated water producing apparatus of the supersonic washing machine of a ninth embodiment of the invention.
Figure 29:
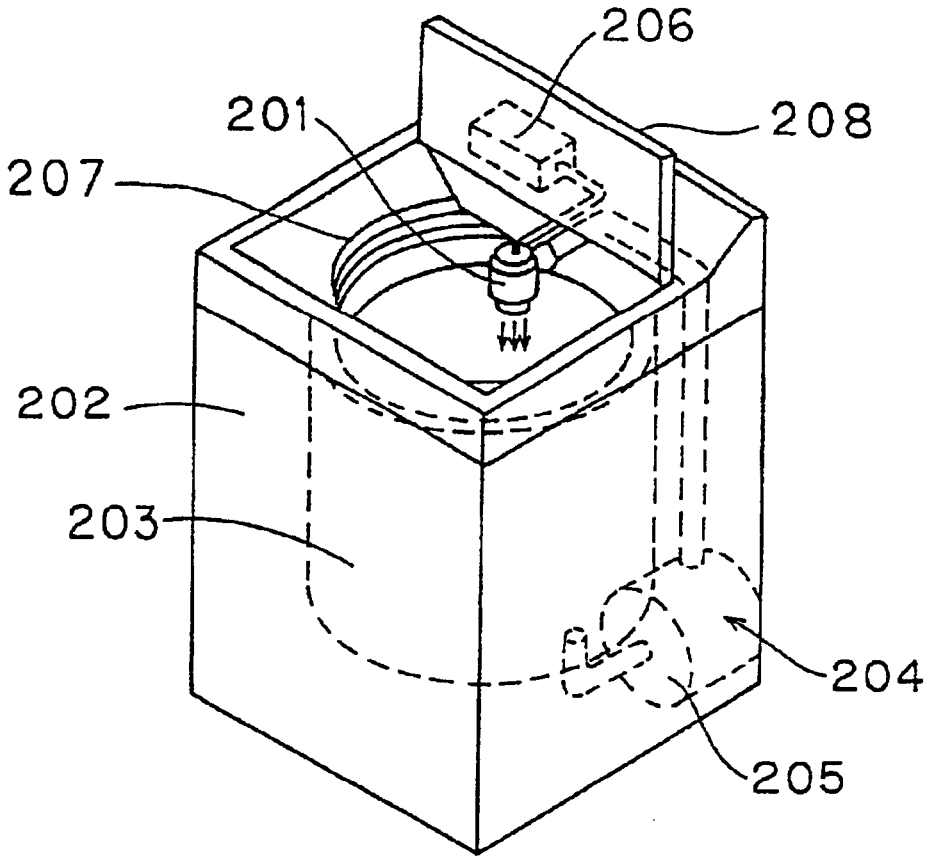
FIG.29 PRIOR ART
FIG. 29 is a perspective view of a conventional washing machine having a partial washing apparatus.
Figure 30:
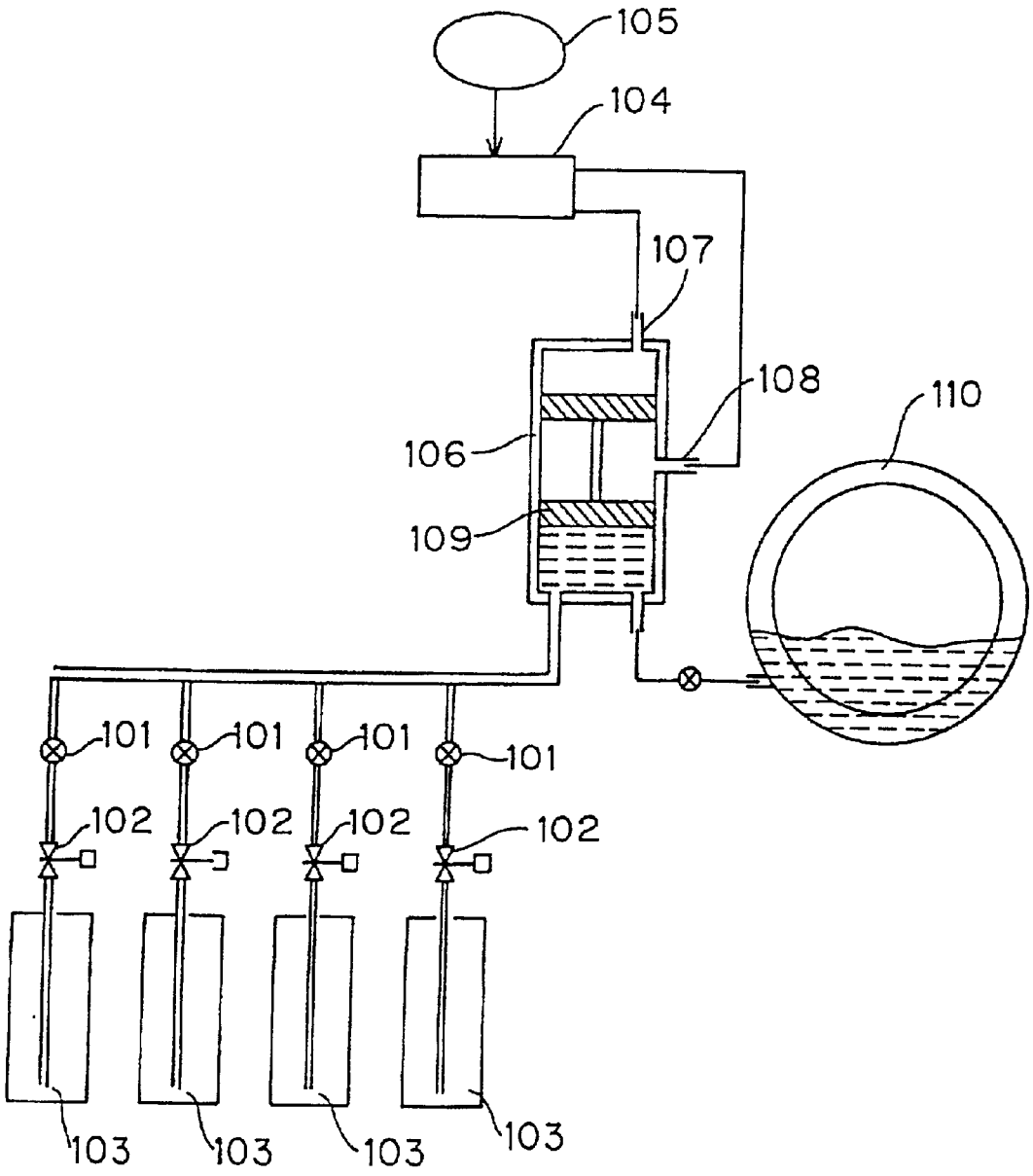
FIG.30 PRIOR ART
FIG. 30 is a diagram showing the construction of a conventional washing machine.

FIG. 28 is a diagram showing the construction of the functional water producing apparatus 84 of the supersonic washing apparatus of a ninth embodiment of the invention. The supersonic washing apparatus of this embodiment has the same overall construction as that of the seventh embodiment shown in FIG. 25, and is different therefrom only in that the functional water producing apparatus 84 here is realized as a deaerated water producing apparatus 84*c*.

In FIG. 28, arrows indicate the flow of a washing liquid and tap water, and the upstream end of the piping is connected to a faucet (not shown) of tap water. As shown in this figure, the deaerated water producing apparatus 84*c* has a hollow fiber unit 93. On the upstream side of the hollow fiber unit 93 is arranged a three-way valve sod. In the flow path that branches off the three-way valve 90*d* downward is arranged an aspirator 94 for decompressing the inside of the hollow fiber unit 93.

When tap water is supplied to the piping and the three-way valve 90*d* is opened, the tap water, flowing from the direction indicated by the arrow D, passes through the hollow fiber unit 93 and is then fed to the water-feed pipe 16 of the supersonic washing apparatus 80.

Meanwhile, part of the tap water passing through the hollow fiber unit 93 is diverted to the aspirator 94. Here, if the piping from the aspirator 94 is connected to the washing sink (not shown) of an electric washing machine, it is possible to perform washing simultaneously on the electric washing machine. This helps prevent water from being wasted.

Moreover, the hollow fiber unit 93 has a dual construction; when the outer space thereof is decompressed by the aspirator 94, the tap water passing through the hollow fiber provided in the inner space thereof is deaerated. Furthermore, in cases where partial washing is performed with the supersonic washing apparatus 80 kept operating for a long time, water may be circulated back from the washing sink with a pump 95 so that deaerated water is produced continuously.

If water contains much gas dissolved in it, the dumping action of the gas attenuates supersonic vibration and thereby lowers the transmission efficiency. Normally, the concentration of oxygen dissolved in tap water is about 7 to 8 ppm. However, deaerating tap water by the method described above makes the concentration of oxygen dissolved in it as low as about 3 ppm. Table 3 shows the effect of deaeration on the intensity of the supersonic vibration applied to tap water in the supersonic washing apparatus of this embodiment.

As Table 3 shows, deaeration more than doubles the intensity of the supersonic vibration transmitted to the tap water. This increases the degree of cavitation caused in the water, which is one of the factors that contribute to better detergency, and thus helps achieve a satisfactory washing effect. Moreover, with deaeration, it is possible to maintain adequate detergency with a lower supersonic vibration output, and thus the supersonic washing apparatus can be operated at a low output. This helps reduce the electric power consumption and thus the running costs of the supersonic washing apparatus 80.

The deaerated water producing apparatus 84*c* used in this embodiment may be used in combination with one or both of the electrolyzed water producing apparatus 84*a* and the water softening apparatus 84*b* described previously in connection with the seventh and eighth embodiments. In such cases, in addition to the effect described just above, a reduction in the amount of detergent needed is also expected as a synergistic effect.

Moreover, any of the supersonic washing apparatuses 80 of the seventh to ninth embodiments may be incorporated in a washing machine as a partial washing apparatus for performing partial washing. Moreover, by performing partial washing with a liquid-feed tank 25 (see FIGS. 12 and 15) as used in the third or fourth embodiment filled with functional water as obtained by using the electrolyzed water producing apparatus 84*a*, water softening apparatus 84*b*, or deaerated water producing apparatus 84*c* of the seventh, eighth, or ninth embodiment, it is possible to enhance the washing effect of partial washing.

TABLE 1

Comparison of the Amount of Detergent Used

| Amount of Detergent Used | | Standard | ½ | ⅓ |
|---|---|---|---|---|
| Washing Efficacy (%) | Alkaline-ion Water | 79.0 | 78.3 | 78.8 |
| | Tap Water | 78.6 | 67.9 | 61.9 |

TABLE 2

Effect of Water Softening on Washing Efficacy

| Hardness of Washing Liquid | 48 (Unprocessed) | 30 | 15 |
|---|---|---|---|
| Washing Efficacy (%) | 79.3 | 85.5 | 88.3 |

TABLE 3

Effect of Deaeration on Supersonic Vibration Intensity

| Dissolved Oxygen (ppm) | 7.3 (Unprocessed) | 3.4 |
|---|---|---|
| Sound Pressure Level | 1 | 2.25 |

What is claimed is:

1. A washing machine having a washing tub in which to put an article to be washed and comprising:

a partial washing apparatus that removes dirt from the article to be washed by means of supersonic vibration, wherein the partial washing apparatus comprises:

a supersonic resonator for generating supersonic vibration; and a supersonic vibration horn for amplifying the supersonic vibration, the supersonic vibration horn being arranged with a tip thereof placed near the article to be washed, wherein the washing machine proper has a lid that is opened by being folded in two portions, of which the portion that lies in front permits the partial washing apparatus to be fitted thereon approximately at a lateral center thereof.

2. A washing machine having a partial washing apparatus as claimed in claim 1, wherein the partial washing apparatus has a cover that is movable between a position in which it exposes the supersonic vibration horn and a position in which it covers the supersonic vibration horn.

3. A washing machine having a partial washing apparatus as claimed in claim 2, wherein the cover has an end surface at a tip thereof subjected to a friction reduction process.

4. A washing machine having a partial washing apparatus as claimed in claim 1, further comprising:

a bracket member that is detachably attachable to the washing machine proper, wherein the partial washing apparatus is fitted to the washing machine proper with the bracket member.

5. A washing machine having a partial washing apparatus as claimed in claim 1, wherein a washing liquid is fed to a portion of the partial washing apparatus where the article to be washed is washed.

6. A washing machine having a partial washing apparatus as claimed in claim 1, wherein a case is provided that covers the supersonic vibration horn and that has an opening formed in a portion thereof corresponding to the tip of the supersonic vibration horn so that the tip of the supersonic vibration horn protrudes out through the opening.

7. A washing machine having a partial washing apparatus as claimed in claim 1, wherein the partial washing apparatus is fitted to the washing machine proper so as to be movable between an in-use position above the washing machine in which the partial washing apparatus is placed when in use and a not-in-use position, different from the in-use position, in which the partial washing apparatus is placed when not in use.

8. A washing machine having a partial washing apparatus as claimed in claim 1, wherein a holding member is provided that is pivotably supported in a peripheral portion of the washing machine at one end and that has the partial washing apparatus fitted at another end so that, as the holding member is pivoted, the partial washing apparatus is moved between the in-use position and the not-in-use position.

9. A washing machine having a partial washing apparatus as claimed in claim 1, wherein a slit into which to insert the particle to be washed is provided below the supersonic vibration horn.

10. A washing machine having a partial washing apparatus as claimed in claim 9, wherein a case is provided so as to cover the supersonic vibration horn, and the slit is formed in a lower portion of the case so as to be perpendicular to the tip of the supersonic vibration horn.

11. A washing machine having a partial washing apparatus as claimed in claim 10, wherein the slit is formed by an upper cover and a lower cover that together constitute the case.

12. A washing machine having a partial washing apparatus as claimed in claim 11, wherein an opening is formed in the upper cover, and the tip of the supersonic vibration horn is arranged so as to point to the opening.

13. A washing machine having a partial washing apparatus as claimed in claim 12, wherein an opening communicating with a drain outlet is formed in a lower cover in which the slit is formed, right below the supersonic vibration horn.

14. A washing machine having a partial washing apparatus as claimed in claim 9, wherein a washing liquid is fed to the slit.

15. A washing machine having a washing tub in which to put an article to be washed and comprising:

a partial washing apparatus that removes dirt from the article to be washed by means of supersonic vibration, wherein the partial washing apparatus comprises:

a supersonic resonator for generating supersonic vibration;

a supersonic vibration horn for amplifying the supersonic vibration, the supersonic vibration horn being arranged with a tip thereof placed near the article to be washed; and a liquid-feed tank for storing the washing liquid, which is fed therefrom to the tip of the supersonic vibration horn.

16. A washing machine having a partial washing apparatus as claimed in claim 15, wherein the liquid-feed tank has a recessed portion, in which the supersonic resonator is arranged.

17. A washing machine having a partial washing apparatus as claimed in claim 15, further comprising:

a case that covers the partial washing apparatus and that has a slit formed therein in which the article to be washed is inserted, wherein the washing liquid is fed to the slit.

18. A washing machine having a partial washing apparatus as claimed in claim 17, wherein the partial washing apparatus has an upper cover and a lower cover arranged below the upper cover, and the article to be washed inserted in the slit is placed between the upper and lower covers, wherein the upper cover is so curved as to be convex downward, with an opening formed at a bottom, and the washing liquid is fed to an inner portion of the upper cover, wherein the lower cover is so curved as to be convex upward, with an opening formed at a top, and wherein the tip of the supersonic vibration horn is arranged in the opening of the upper cover at a level identical with or lower than that opening.

19. A washing machine having a partial washing apparatus as claimed in claim 18, wherein the partial washing apparatus has a solid soap chamber for storing a cake of solid soap with a lower end thereof exposed, wherein the solid soap chamber has a pressing portion for pressing the solid soap downward so as to keep the lower end of the solid soap at a level approximately identical with the tip of the supersonic vibration horn.

20. A washing machine having a partial washing apparatus as claimed in claim 15, wherein the partial washing apparatus has a solid soap chamber for storing a cake of solid soap with a part thereof exposed, and the solid soap is applied to the article to be washed when water is fed to the article to be washed.

21. A washing machine having a partial washing apparatus as claimed in claim 15, wherein the liquid-feed tank permits a plurality of washing liquids to be stored separately so that one of the washing liquids can be selectively fed to the article to be washed.

22. A washing machine having a partial washing apparatus as claimed in claim 21, wherein the partial washing apparatus comprises:

the liquid-feed tank having a plurality of reservoirs;

a pumping device for feeding a washing liquid from the reservoirs to the article to be washed;

a plurality of valves provided one between each of the reservoirs and the pumping device;

an input device that issues an instruction that one of the valves be selectively opened; and a controller that opens one of the valves in accordance with the instruction from the input device and that then drives the pumping device.

23. A washing machine having a partial washing apparatus as claimed in claim 21, wherein the liquid-feed tank is composed of a plurality of liquid-feed tanks of which one is selectively fitted to the partial washing apparatus.

24. A washing apparatus comprising:

a supersonic wave generator;

a supersonic vibration horn for amplifying supersonic vibration, the supersonic vibration horn having a slit formed in a lower portion thereof so as to permit an article to be washed by the washing apparatus to be inserted in the slit wherein a case is provided so as to cover the supersonic vibration horn, and the slit is formed in a lower portion of the case so as to be perpendicular to the tip of the supersonic vibration horn.

25. A washing apparatus as claimed in claim 24, wherein a gap is formed by an upper cover and a lower cover that together constitute the case.

26. A washing apparatus as claimed in claim 25, wherein an opening is formed in the upper cover, and the tip of the supersonic vibration horn is arranged so as to point to the opening.

27. A washing apparatus as claimed in claim 26, wherein an opening communicating with a drain outlet is formed in a lower wall surface in which the slit is formed, right below the supersonic vibration horn.

* * * * *